US011459813B2

(12) United States Patent
Tokudome et al.

(10) Patent No.: US 11,459,813 B2
(45) Date of Patent: Oct. 4, 2022

(54) DOOR OPENING AND CLOSING DEVICE

(71) Applicant: U-Shin Ltd., Tokyo (JP)

(72) Inventors: Tetsuo Tokudome, Hiroshima (JP); Etsuro Watanabe, Hiroshima (JP)

(73) Assignee: U-SHIN LTD., Tokyo (JP)

( * ) Notice: Subject to any disclaimer, the term of this patent is extended or adjusted under 35 U.S.C. 154(b) by 377 days.

(21) Appl. No.: 16/825,054

(22) Filed: Mar. 20, 2020

(65) Prior Publication Data

US 2020/0340286 A1 Oct. 29, 2020

(30) Foreign Application Priority Data

Apr. 26, 2019 (JP) ..... JP2019-085868

(51) Int. Cl.
*E05F 15/73* (2015.01)

(52) U.S. Cl.
CPC ..... *E05F 15/73* (2015.01); *E05Y 2900/531* (2013.01)

(58) Field of Classification Search
CPC ..... E05F 15/73; E05F 2015/763; E05Y 2900/531; E05Y 2400/818; E05Y 2800/21; E05Y 2900/546; E05Y 2400/54; E05Y 2900/532; B60R 25/01; B60R 25/20
See application file for complete search history.

(56) References Cited

U.S. PATENT DOCUMENTS

2016/0312517 A1* 10/2016 Elie ..... E05F 15/73
2016/0314362 A1* 10/2016 Elie ..... G06V 20/58
2017/0114583 A1* 4/2017 Banvait ..... E05F 15/40
2019/0017299 A1* 1/2019 Capalau ..... E05B 81/12
2020/0157873 A1* 5/2020 Sabatini ..... B60Q 1/323
2020/0284876 A1* 9/2020 Hurd ..... G01S 7/414
2020/0340286 A1* 10/2020 Tokudome ..... E05F 15/73

FOREIGN PATENT DOCUMENTS

JP 2017-82390 5/2017

* cited by examiner

*Primary Examiner* — An T Nguyen
(74) *Attorney, Agent, or Firm* — Wenderoth, Lind & Ponack, L.L.P.

(57) ABSTRACT

A door opening and closing device includes: first and second detectors repeatedly detect a distance to a detection target around the door; and a control unit opens and closes the door using a drive unit when a predetermined operation having a plurality of stages performed by a moving object is detected. The control unit determines whether first and second objects respectively detected by the first and second detectors are the moving or stationary object. When one of the first and second objects is the moving object and the other is the stationary object and a distance to the stationary object is shorter than a first determination value, both the detection results of the first and second detectors are used for detection at a final stage, and only the detection result of the first or second detector detecting the moving object is used for detection at the other stages.

9 Claims, 19 Drawing Sheets

DOOR OPENING AND CLOSING DEVICE

BACKGROUND OF THE INVENTION

Technical Field

The present invention relates to a door opening and closing device.

Description of the Related Art

There has been known a door opening and closing device capable of automatically opening and closing a door without user's touching on a door handle. A door opening and closing device disclosed in JP 2017-82390 A opens and closes a door by a drive unit if a user performs a predetermined operation in a detection section formed of an overlapping portion between detection ranges respectively provided by a pair of distance measurement sensors.

SUMMARY OF THE INVENTION

There is a case where it is difficult to secure the entire length of the detection section when an obstacle (stationary object) such as a wall and another vehicle exists around a vehicle. In this case, it is difficult to detect the predetermined operation of the user, and thus, the door opening and closing device of Patent Literature 1 has room for improvement.

An object of the present invention is to provide a door opening and closing device capable of opening and closing a door even when a stationary object exists around a vehicle.

One aspect of the present invention is a door opening and closing device including: a driving unit that opens and closes a door with respect to a vehicle body; a first detector and a second detector that are arranged on the vehicle body with an interval in the horizontal direction and repeatedly detect distances to detection targets including a moving object and a stationary object around the door, respectively; and a control unit that opens and closes the door using the drive unit when a predetermined operation having a plurality of stages performed by the moving object is detected based on a detection result of the first detector and a detection result of the second detector. The control unit determines whether a first detection target, which is the detection target detected by the first detector, is the moving object or the stationary object based on the detection result of the first detector, and determines whether a second detection target, which is the detection target detected by the second detector, is the moving object or the stationary object based on the detection result of the second detector. When one of the first detection target and the second detection target is the moving object and the other is the stationary object and a distance to the stationary object is shorter than a first determination value, both the detection result of the first detector and the detection result of the second detector are used for detection at a final stage among the plurality of stages, and only the detection result of the one of the first detector and the second detector that has detected the moving object is used for detection at stages other than the final stage.

In the door opening and closing device of the present invention, when the distance to the stationary object is shorter than the first determination value, only the detection result of the one of the first detector and the second detector that has detected the moving object is used for the detection at the stages other than the final stage among the plurality of stages included in the predetermined operation. Therefore, even if a free area around the vehicle is narrow due to the presence of the stationary object, it is possible to secure a space (distance) for a user (the moving object) to perform the predetermined operation, and thus, the door can be open and closed by detecting the operation of the user.

According to the present invention, even when the stationary object exists around the vehicle, the door can be opened and closed by detecting the predetermined operation of the user.

BRIEF DESCRIPTION OF THE DRAWINGS

The foregoing and the other features of the present invention will become apparent from the following description and drawings of an illustrative embodiment of the invention in which.

DETAILED DESCRIPTION OF EMBODIMENTS

Hereinafter, embodiments of the present invention will be described with reference to the drawings.

First Embodiment

Figure 1:
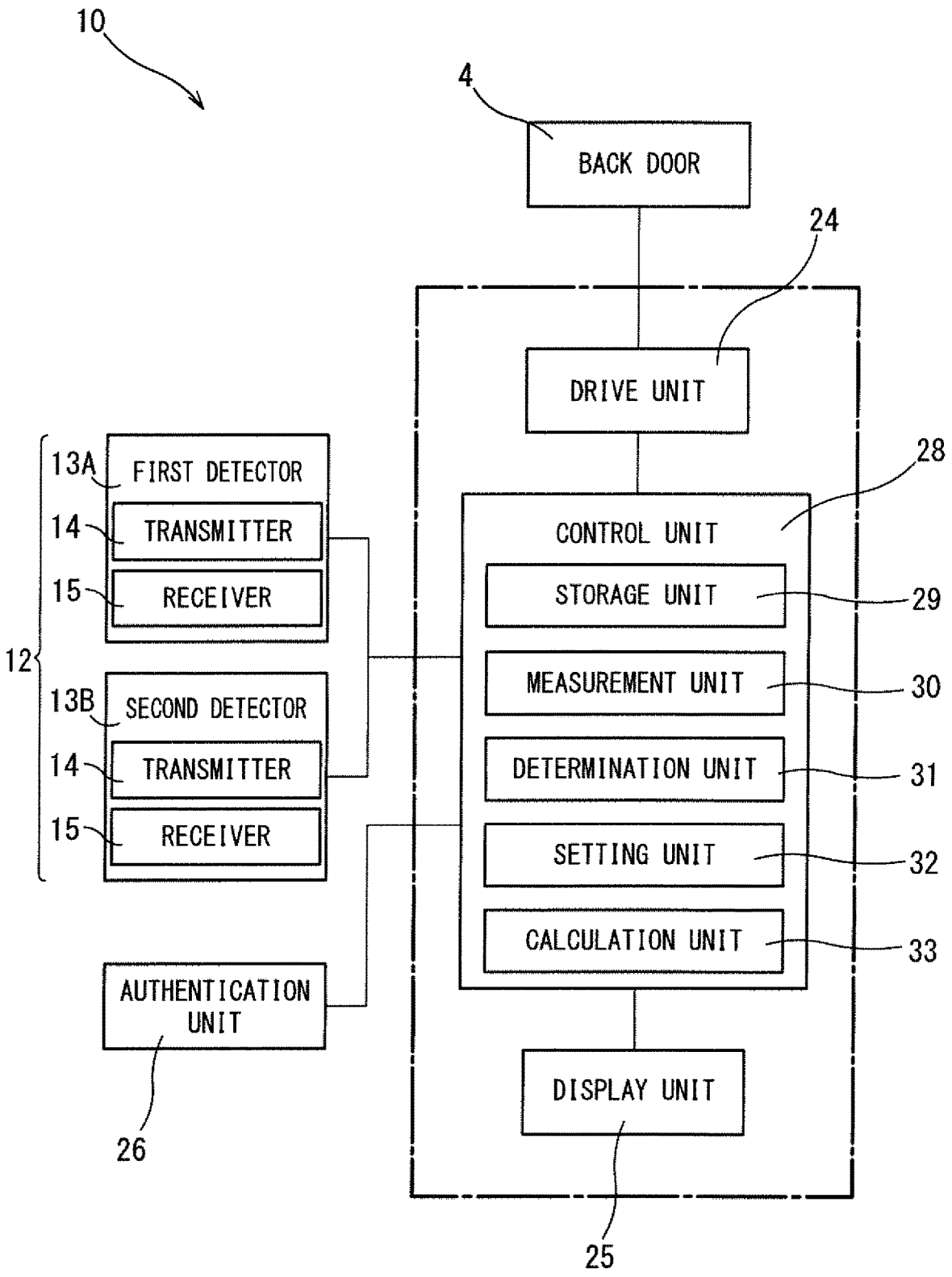
FIG. 1 is a block diagram illustrating a door opening and closing device according to a first embodiment of the present invention.

FIG. 1 illustrates a door opening and closing device 10 for a vehicle according to a first embodiment of the present invention. When a user performs predetermined operations Ma and Mb behind a vehicle 1 as illustrated in FIGS. 2B to 2D, the door opening and closing device 10 automatically opens and closes a hatchback door (hereinafter, simply referred to as a door) 4 without requiring the user to use a hand as illustrated in FIGS. 3A and 3B.

As illustrated in FIG. 1, the door opening and closing device 10 includes a detection unit (detection means) 12, a drive unit 24 of the door 4, a display unit 25, an authentication unit 26, and a control unit 28. In FIG. 1, a portion surrounded by the dot-dash line is a configuration added here, and existing components mounted on the vehicle 1 are used for the detection unit 12 and the authentication unit 26. In the vehicle 1 equipped with a remote control type automatic door capable of automatically opening and closing the door 4 using a key (portable device), the drive unit 24 also uses the existing components.

When the detection unit 12 detects a moving object including the user and a third party other than the user, the control unit 28 performs determination (an authentication process) on whether or not the moving object is the user using the authentication unit 26. If the authentication fails, the control unit 28 determines that the moving object is the third party, and does not open or close the door 4. When it is determined that the moving object is the user with the authentication success, the control unit 28 detects the predetermined operation of the user based on a change of a distance detected by the detection unit 12. At this time, the control unit 28 changes a display state of the display unit 25 so that the user can recognize the detection state and the timing to perform the next motion. When it is determined that the predetermined operation has been established, the control unit 28 causes the drive unit 24 to drive for opening when the door 4 is in a closed state as illustrated in FIG. 3A or causes the drive unit 24 to drive for closing when the door 4 is in an open state as illustrated in FIG. 3B.

Figure 2A:
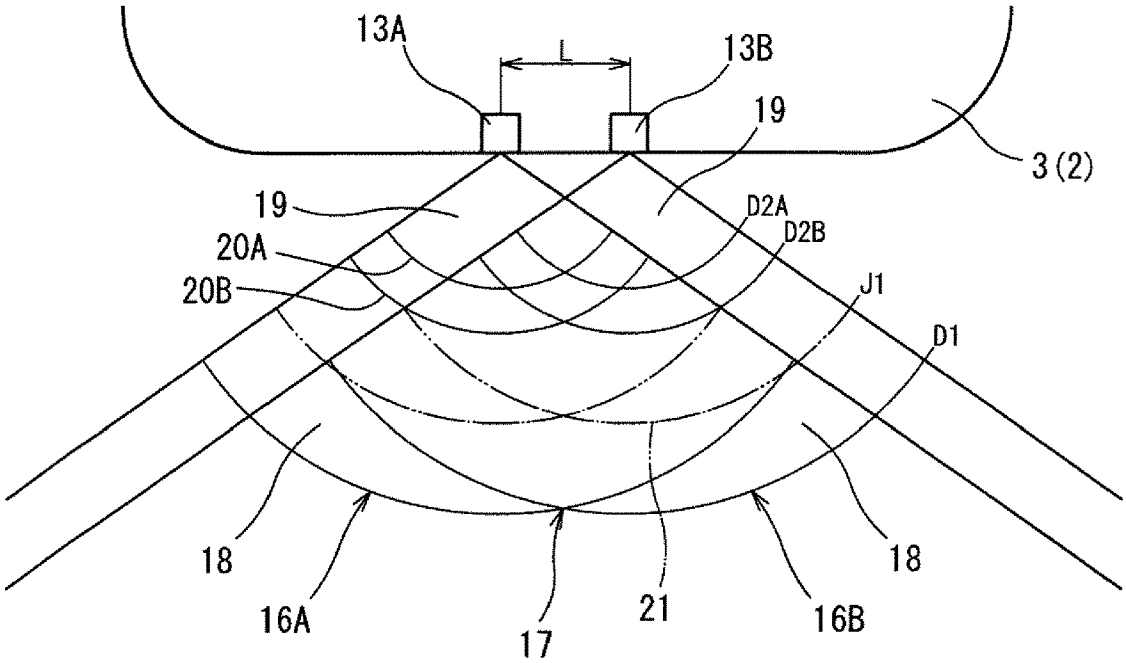
FIG. 2A is a plan view illustrating a detection range according to the first embodiment.
Figure 2B:
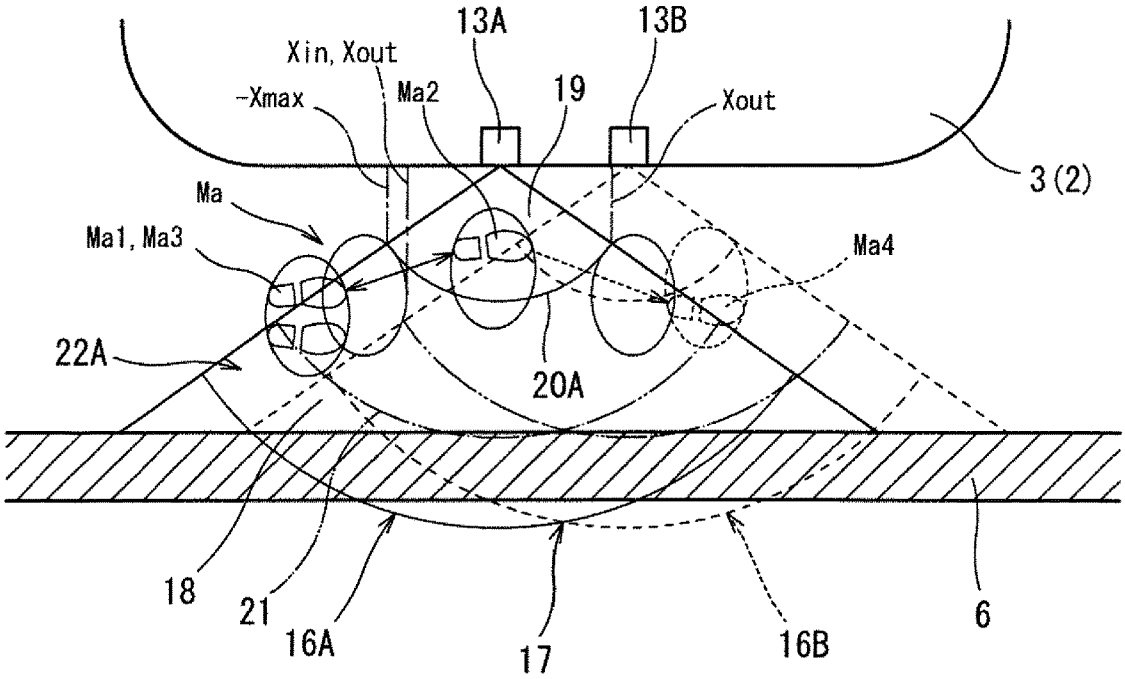
FIG. 2B is a plan view illustrating a state where a wall exists around a door and a first detection range is set as a detection section.
Figure 2C:
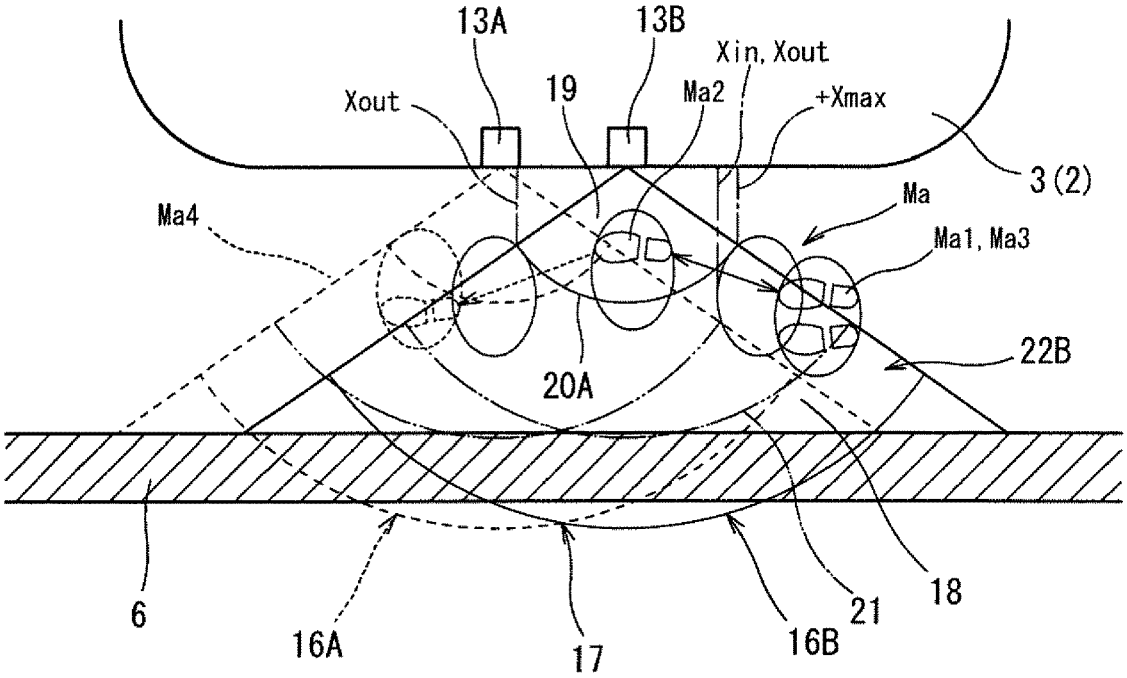
FIG. 2C is a plan view illustrating a state where the wall exists around the door and a second detection range is set as a detection section.
Figure 2D:
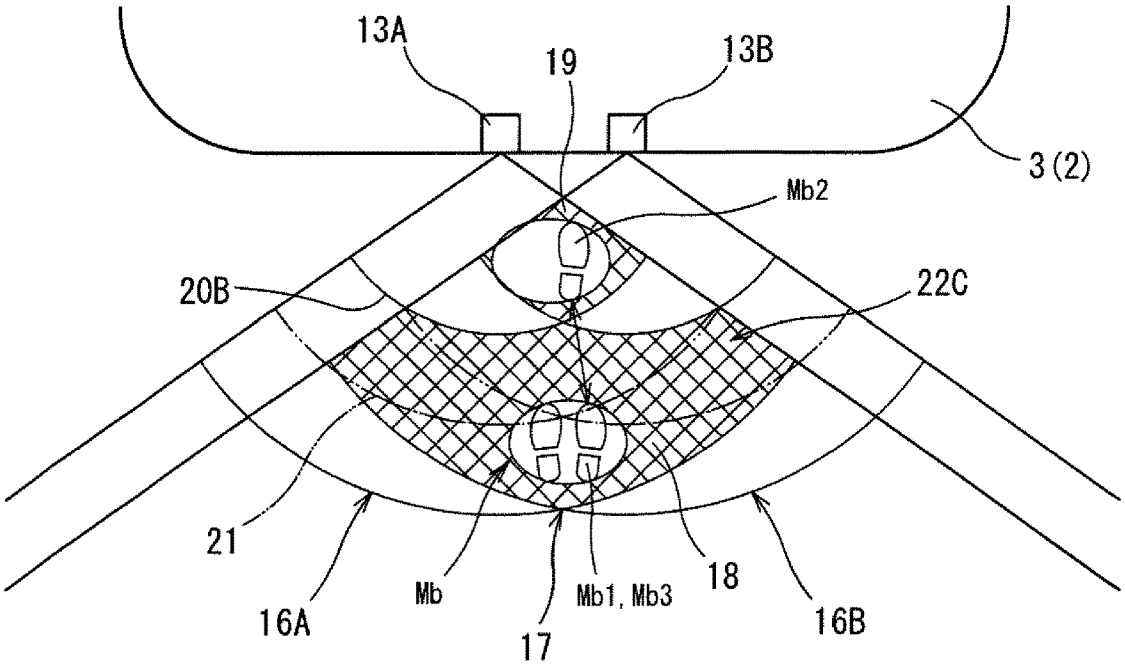
FIG. 2D is a plan view illustrating a detection range and a detection section when there is no wall around the door.
Figure 3A:
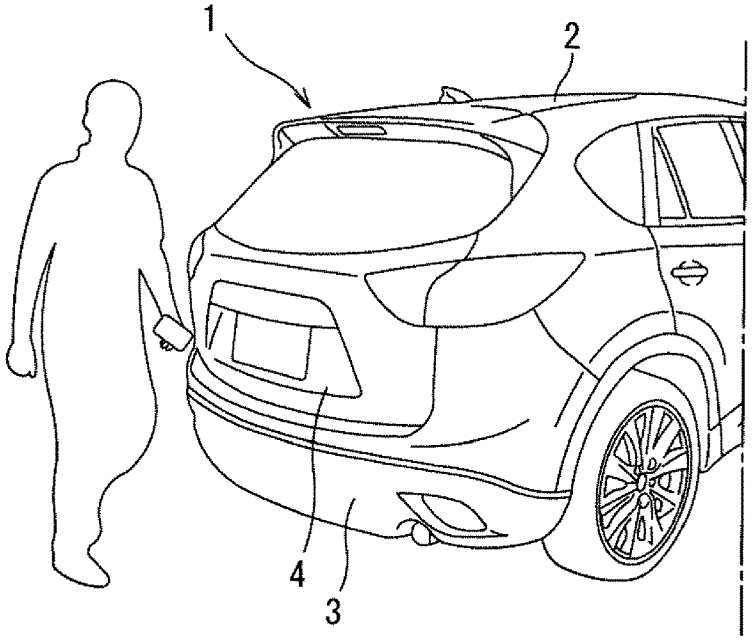
FIG. 3A is a perspective view illustrating a closed state of the door.
Figure 3B:
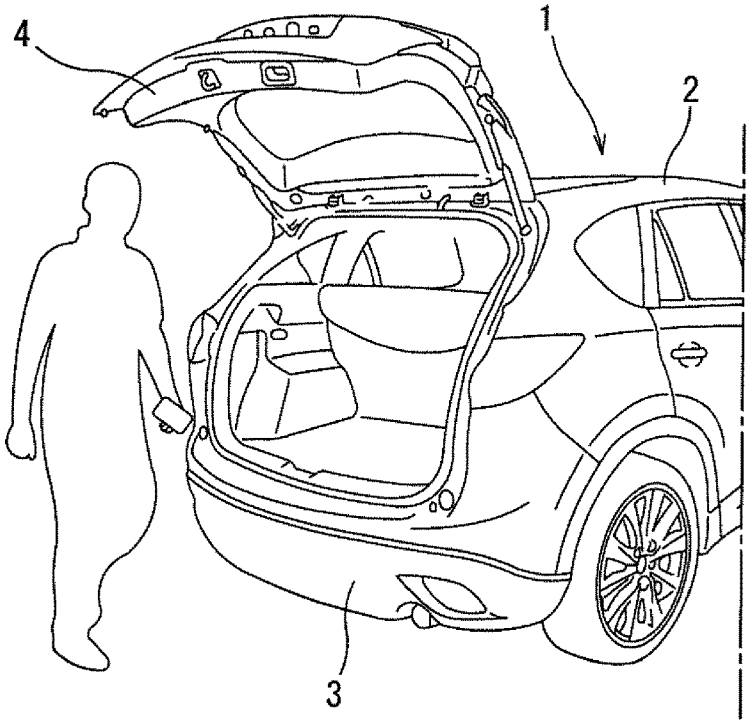
FIG. 3B is a perspective view illustrating an open state of the door.

Referring to FIGS. 2B to 2D, the predetermined operations Ma and Mb are different depending on whether or not a wall (stationary object) 6, which is an obstacle, exists behind the vehicle 1 (around a rear bumper 3). As illustrated in FIGS. 2B and 2C, the operation Ma in a case where the wall 6 exists and a free area around the door 4 is narrow is set as a series of motions (a plurality of stages) of moving forward and backward in the horizontal direction (that is, the width direction of the vehicle 1) substantially along the door 4 (rear bumper 3) (Ma1→Ma2→Ma3). As illustrated in FIG. 2D, the operation Mb in a case where the wall 6 does not exist and the free space around the door 4 (rear bumper 3) is wide is set as a series of motions (a plurality of stages) of moving forward and backward in a direction intersecting with the door 4 (rear bumper 3) (that is, the longitudinal direction of the vehicle 1) (Mb1→Mb2→Mb3).

The detection unit 12 repeatedly detects a detection target including a moving object and a stationary object located within a defined detection range every set time (for example, 80 msec). The stationary object includes not only the wall 6 but also other vehicles which are adjacently parked or the like. The detection unit 12 includes a pair of detectors 13A and 13B attached to the rear bumper 3 (a vehicle body 2) so as to be located with an interval in the vehicle width direction (horizontal direction) along the door 4. As the detectors 13A and 13B, two sensors two located at the center among four ultrasonic sensors used as back sonar sensors are shared. The four ultrasonic sensors constituting the back sonar are mounted in order to monitor the rear of the vehicle 1 during traveling. Since two sensors among these four ultrasonic sensors are used, an increase in cost caused by mounting the door opening and closing device 10 on the vehicle 1 is suppressed. In the following description, there is a case where a sensor located on the left side in FIG. 2A will be referred to as the first detector 13A, and a sensor located on the right side in FIG. 2A will be referred to as the second detector 13B.

Referring to FIG. 1, the detectors 13A and 13B are connected to the control unit 28 via a communication cable so as to be capable of communicating with each other, and the control unit 28 is connected to an electronic control unit (ECU) (not illustrated) so as to be capable of communicating with each other. However, the detectors 13A and 13B may be connected to the ECU so as to be capable of communicating with each other, and the control unit 28 may receive detection results of the detectors 13A and 13B from the ECU. Each of the detectors 13A and 13B includes a transmitter 14 and a receiver 15. Ultrasonic waves emitted from the transmitters 14 form detection ranges 16A and 16B that spread in a substantially conical shape toward the rear of the vehicle 1. As illustrated in FIG. 2A, the detection ranges 16A and 16B spread in a fan shape (for example, with the center angle of about 110 degrees) are formed on the ground. The detection ranges 16A and 16B partially overlap each other. Reflected waves of the ultrasonic waves transmitted from the transmitters 14 are received by the receivers 15. Such detection results are used for determination on the presence or absence of a detection target within the detection ranges 16A and 16B and for calculation of a distance to the detection target.

The detection ranges 16A and 16B of the detectors 13A and 13B will be described more specifically with reference to FIG. 2A.

First, the detection ranges 16A and 16B are set respectively in areas from the detectors 13A and 13B to a set distance D1 (for example, 120 cm). The entire detection ranges 16A and 16B combining both the areas is an approach area 17 configured to perform the authentication by the authentication unit 26 when a moving object enters. As described above, the predetermined operation Ma of the user is the forward and backward movement along the vehicle width direction when the wall 6 exists around the door 4 (see FIGS. 2B and 2C), and the predetermined operation Mb of the user is the forward and backward movement along the vehicle length direction when the wall 6 does not exist (see FIG. 2D). In order to detect these operations Ma and Mb within the approach area 17, each of the detection ranges 16A and 16B are divided into a start section 18 and a trigger section 19 according to the distance from each of the detectors 13A and 13B.

A boundary between the start section 18 and the trigger section 19 differs depending on whether the wall 6 exists within a first determination value J1 (for example, 90 cm) shorter than a set distance D1. A first boundary line 20A in the case where the wall 6 exists is set at a position of a set distance D2A (for example, 45 cm) shorter than the determination value J1 (a determination line 21). A second boundary line 20B in the case where the wall 6 does not exist is set at a position of a set distance D2B (for example, 60 cm) shorter than the determination value J1 and longer than the set distance D2A.

When the first boundary line 20A is used, the start section 18 is configured using an area from the set distance D1 to the set distance D2A, and the trigger section 19 is configured using an inner area from the set distance D2A located closer to the door 4 than the start section 18. When the second boundary line 20B is used, the start section 18 is configured using an area from the set distance D1 to the set distance D2B, and the trigger section 19 is configured using an inner area from the set distance D2B located closer to the door 4 than the start section 18.

When the wall 6 exists around the door 4, the position of the first boundary line 20A is arranged to be closer to the door 4 than the position of the second boundary line 20B, thereby securing the area of the start section 18 to perform the operation Ma in the vehicle width direction. When the wall 6 does not exist, the position of the second boundary line 20B is arranged to be farther from the door 4 than the position of the first boundary line 20A, thereby securing the area (distance) to perform the operation Mb in the vehicle length direction.

Referring to FIGS. 2B to 2D, the operations Ma and Mb for opening and closing the door 4 include a first motion (first stage) of moving from the start section 18 (Ma1 or Mb1) to the trigger section 19 (Ma2 or Mb2) and a second motion (last stage) of returning from the trigger section 19 (Ma2 or Mb2) to the start section 18 (Ma3 or Mb3) again regardless of the presence or absence of the wall 6. That is, the predetermined operations Ma and Mb have a plurality of (two in the present embodiment) stages. Note that the predetermined operations Ma and Mb of the present embodiment have the two stages, but may have three or more stages.

As illustrated in FIGS. 1, 3A and 3B, the drive unit 24 opens and closes the door 4 with respect to the vehicle body 2. Although not illustrated, the drive unit 24 is constituted by a motor, a gear mechanism, a damper, and the like that can rotate the door 4 in an opening direction and a closing direction. The drive unit 24 is connected to the control unit 28 via a communication cable so as to be capable of communicating with each other. However, the drive unit 24 may be electrically connected to the ECU, and the control unit 28 may transmit a drive signal of the drive unit 24 controlled by the control unit 28 to the ECU, and the ECU may transmit the drive signal to the drive unit 24.

The display unit 25 is configured using an LED and performs optical display configured to guide a user. Although not illustrated in detail, the display unit 25 is mounted on a substrate in a casing attached to the center of the rear bumper 3 in the width direction, and is connected to the control unit 28 via a communication cable so as to be capable of communicating with each other. Light of the display unit 25 is condensed by a lens, and emits onto the ground (an overlapping portion between the pair of trigger sections 19) with an illuminance that can be visually recognized by the user when the periphery of the vehicle 1 is not only dark but also bright.

The authentication unit 26 includes a transceiver having a vehicle exterior low frequency (LF) transmission/reception antenna that communicates with a key using an LF signal and performs authentication of the key outside the vehicle. The transceiver is connected to the control unit 28 via a communication cable so as to be capable of communicating with each other, but may be connected to the ECU so as to be capable of communicating with each other. The transceiver is activated in response to a command from the ECU, and performs communication relating to the authentication process. In the authentication process, the authentication unit 26 requests the key to transmit an authentication code, compares the authentication code received from the key with a registered regular code, and if they match (authentication is successful), determines that the moving object is the user.

The control unit 28 starts control to open and close the door 4 when the vehicle 1 is parked and the engine is stopped. In this door opening and closing control, the control unit 28 causes the drive unit 24 to open and close the door 4 if the key authentication is successful and detects (establishment) of the predetermined operations Ma and Mb of the user based on the change of the distance based on the detection results of the detectors 13A and 13B. Specifically, as illustrated in FIG. 1, the control unit 28 includes a storage unit 29, a measurement unit 30, a determination unit 31, a setting unit 32, and a calculation unit 33, is constituted by one or more microcomputers and other electronic devices, and is connected to the ECU so as to be capable of communicating with each other.

The storage unit 29 stores a control program, setting data such as a threshold and a determination value to be used in the control program, and a data table configured to calculate a distance from the detection results of the detectors 13A and 13B. Further, the storage unit 29 stores the detection results of the detectors 13A and 13B (distance information measured by the measurement unit 30). Further, the storage unit 29 stores setting information indicating one of detection sections 22A to 22C set by the setting unit 32, and coordinate information of the moving object calculated by the calculation unit 33.

The measurement unit 30 measures the distance from each of the detectors 13A and 13B to a detection target based on the time (detection result) between transmission of an ultrasonic wave from the transmitter 14 and reception of a reflected wave by the receiver 15. That is, the measurement unit 30 and the detectors 13A and 13B constitute a distance measurement sensor that measures the distances from the detectors 13A and 13B to the detection target. The measurement result is stored in the storage unit 29 as distance information. When two or more detection targets are present at different positions in the detection ranges 16A and 16B, the number of measurement results obtained by the detectors 13A and 13B is the same as the number of objects.

The determination unit 31 individually determines whether the detection target is a moving object or a stationary object based on a change of the distance for a predetermined period measured (detected) by the detectors 13A and 13B and the measurement unit 30. That is, whether a first detection target detected by the first detector 13A is a moving object or a stationary object is determined based on the detection result of the first detector 13A including the measurement unit 30. Further, whether a second detection target detected by the second detector 13B is a moving object or a stationary object is determined based on the detection result of the second detector 13B including the measurement unit 30

More specifically, if a difference (change amount) between a current detection result and a previous detection result is large, a moving distance of the detection target is long and a moving speed is high. Conversely, if the change amount is small, the moving distance of the detection target is short, and the moving speed is slow. If moving speeds Va and Vb based on the detection results of the individual detectors 13A and 13B are lower than a predetermined determination value J3 (for example, 20 mm/sec), the determination unit 31 determines that the detection target is the stationary object (is stationary). If the moving speeds Va and Vb are equal to or higher than the determination value J3, the determination unit 31 determines that the detection target is the moving object (is moving). This determination may be made only by one-time comparison, or may be made when the same comparison result is continuously obtained a predetermined number of times (for example, eight times=640 msec). Note that an average inclination (a change rate of the distance) of detection results for a predetermined number of times may be calculated as the moving speeds Va and Vb.

As illustrated in FIGS. 2B to 2D, the setting unit 32 sets a part of the approach area 17 as a detection section configured to detect the operations Ma and Mb of the user. The setting unit 32 sets the boundary between the start section 18 and the trigger section 19 as one of the first boundary line 20A and the second boundary line 20B.

Specifically, the setting unit 32 sets a detection section depending on any of the first detection range 16A and the second detection range 16B where the moving object is present. Specifically, as illustrated by Ma1 in FIG. 2B, when the detection target detected by the first detector 13A is the moving object and the detection target detected by the second detector 13B is the stationary object (wall 6), the setting unit 32 sets the first detection range 16A as the detection section 22A. Further, as illustrated by Ma1 in FIG. 2C, when the detection target detected by the first detector 13A is the stationary object and the detection target detected by the second detector 13B is the moving object, the setting unit 32 sets the second detection range 16B as the detection section 22B. Meanwhile, as illustrated by Mb1 in FIG. 2D, when the wall 6 does not exist and the detection targets detected by both the detectors 13A and 13B are the moving objects, the setting unit 32 sets an overlapping portion between the adjacent detection ranges 16A and 16B, more specifically, an overlapping portion between the two start sections 18 and an overlapping portion between the two trigger sections 19 as the detection section 22C. This setting may be made only by one-time determination, or may be made when the same determination result is continuously obtained a predetermined number of times (for example, four times=320 msec).

When the wall 6 exists as in FIGS. 2B and 2C, the setting unit 32 performs setting so as to use the first boundary line 20A closer to the door 4 (rear bumper 3). As a result, the control unit 28 determines the movement of the moving object between the start section 18 and the trigger section 19 based on the first boundary line 20A. On the other hand, when the wall 6 does not exist as in FIG. 2D, the setting unit 32 performs setting so as to use the second boundary line 20B farther from the door 4. As a result, the control unit 28 determines the movement of the moving object based on the second boundary line 20B. This setting may be made only by one-time determination, or may be made when the same determination result is continuously obtained a predetermined number of times (for example, four times=320 msec).

The calculation unit 33 calculates a coordinate of the moving object (an X-coordinate in the vehicle width direction) based on the distance detected by the first detector 13A and the distance detected by the second detector 13B. As described above, a plurality of signals are input to the receiver 15 in accordance with the number of detection targets existing in the detection ranges 16A and 16B. Among them, the calculation unit 33 uses signals (distances Da and Db to the moving object), which have returned earliest, to calculate the X coordinate. The X coordinate is calculated by the following formula with the center between the detectors 13A and 13B as the origin.

$$X = (Da^2 - Db^2 + L^2)/2L - L/2 = (Da^2 - Db^2)/2L \quad \text{[Formula 1]}$$

*Da*: Distance detected by first detector

*Db*: Distance detected by second detector

*L*: Interval between first detector and second detector

As illustrated in FIG. 2B, however, when the first detection range 16A is set as the current detection section 22A and the second detector 13B does not detect the moving object, the X coordinate is set to −Xmax. Further, as illustrated in FIG. 2C, when the second detection range 16B is set as the current detection section 22B and the first detector 13A does not detect the moving object, the X coordinate is set to +Xmax. For example, when the moving object exists in a portion of the first detection range 16A that does not overlap the second detection range 16B, Xin is set by moving from the start section 18 to the trigger section 19 within the first detection range 16A. However, if it is difficult for the second detector 13B to detect the moving object, it is difficult to calculate the X coordinate. In such a case, the X coordinate is set to a fixed value of −Xmax or +Xmax according to the current setting of the detection sections 22A and 22B.

When one of the first detection target detected by the first detector 13A and the second detection target detected by the second detector 13B is the moving object and the other is the stationary object and the distance to the stationary object is shorter than the determination value J1, the detection result used to detect the predetermined operations Ma and Mb differs depending on the stage. Specifically, the detection result (distance Da or Db) of one of the two detectors 13A and 13B that has detected the moving object is used for detection of the first motion (first stage) from the start section 18 to the trigger section 19. Further, both the detection results (distances Da and Db) of the two detectors 13A and 13B are used for detection of the second motion (the final stage) from the trigger section 19 to the start section 18.

Specifically, as illustrated in FIG. 2B, when the first detection target detected by the first detector 13A is the moving object and the second detection target detected by the second detector 13B is the stationary object, the control unit 28 uses only the distance Da detected by the first detector 13A to detect the first motion of the moving object. As illustrated in FIG. 2C, when the first detection target detected by the first detector 13A is the stationary object and the second detection target detected by the second detector 13B is the moving object, the control unit 28 uses only the distance Db detected by the second detector 13B to detect the first motion of the moving object. In any case, the control unit 28 uses both the distances Da and Db detected by the detectors 13A and 13B to detect the second motion of the moving object.

Meanwhile, as illustrated in FIG. 2D, when both the first detection target detected by the first detector 13A and the second detection target detected by the second detector 13B are the moving objects, the control unit 28 uses both the distances Da and Db detected by the detectors 13A and 13B to determine a series of motions constituting the predetermined operation Mb.

When the wall 6 exists around the door 4, only one distance of the detectors 13A and 13B is used to detect the first motion, but both the distances Da and Db detected by the detectors 13A and 13B are always used for detection of the detection target including the stationary object. Then, the control unit 28 replaces the distance Db or Da detected by the detector 13B or 13A that has detected the stationary object so as to have the same value as the distance Da or Db detected by the detector 13A or 13B that has detected the moving object. That is, when only the distance Da of the first detector 13A is used to detect the moving object, the control unit 28 replaces the distance Db detected by the second detector 13B with the same value as the distance Da detected by the first detector 13A. When only the distance Db of the second detector 13B is used to detect the moving object, the control unit 28 replaces the distance Da detected by the first detector 13A with the same value as the distance Db detected by the second detector 13B.

When the wall 6 does not exist around the door 4, both the distances Da and Db detected by the detectors 13A and 13B are used to detect the moving object. On the other hand, when the wall 6 exists, an actually measured value is used for one of the individual distances detected by the detectors 13A and 13B and a corrected value is used for the other. That is, the two distances Da and Db are used for the opening and closing control of the door 4 regardless of the presence or absence of the wall 6, and thus, the same program can be used.

When the wall 6 exists around the door 4, only one distance of the detectors 13A and 13B is used to detect the first motion, but the distances Da and Db detected by both the detectors 13A and 13B are used for the second motion (determination on whether the predetermined operation Ma is established or not). Of course, even when the wall 6 does not exist, the distances Da and Db detected by both of the detectors 13A and 13B are used to determine whether the predetermined operation Mb is established or not.

Specifically, the control unit 28 determines whether the predetermined operations Ma and Mb are established or not based on the change amount of the X coordinate calculated by the calculation unit 33. More specifically, the control unit 28 compares an absolute value of a difference between a first coordinate (that is, a coordinate of Ma2 or Mb2) when performing the first motion of proceeding from the start section 18 to the trigger section 19 and a second coordinate when moving away from the trigger section 19 with a second determination value J2 (for example, 30 cm). Then, the control unit 28 determines that the predetermined operations Ma and Mb have been established when the absolute value of the difference between a first coordinate Xin and a second coordinate Xout is smaller than the determination value J2, that is, when the second motion of returning from the trigger section 19 to the start section 18 has been performed (that is, a coordinate of Ma3 or Mb3). When the absolute value of the difference between the first coordinate Xin and the second coordinate Xout is equal to or larger than the determination value J2, that is, when a motion of advancing from the trigger section 19 to the start section 18 of the adjacent detection range 16A or 16B has been performed (that is, a coordinate of Ma4 or Mb4), it is determined that the predetermined operations Ma and Mb are not established.

As illustrated in FIGS. 2B and 2C, motions of the user when passing behind the vehicle 1 are Ma1, Ma2, and Ma4. On the other hand, the predetermined operations are Ma1, Ma2, and Ma3. Thus, whether or not the user passes the vehicle by comparing the absolute value of the difference between the first coordinate Xin (the coordinate of Ma2) at the time of performing the first motion and the subsequent second coordinate Xout (the coordinate of Ma3 or Ma4) with the determination value J2. Therefore, it is possible to prevent a malfunction of the door opening and closing device 10 caused by the passage of the user.

As illustrated in FIG. 2D, when the wall 6 does not exist around the door 4, the predetermined operation Mb is forward and backward movement in a direction orthogonal to the door 4, there is almost no movement of the user in the vehicle width direction. Even in this case, the absolute value of the difference between the first coordinate Xin (the coordinate of Mb2) at the time of performing the first motion and the second coordinate Xout (the coordinate of Mb3) at the time of performing the second motion is smaller than the determination value J2. Meanwhile, when the user approaches the vehicle from behind and moves sideways, the absolute value of the difference between the first coordinate Xin and the second coordinate Xout is equal to or larger than the determination value J2. Therefore, even when the overlapping portion is set as the detection section 22C, whether or not the user passes the vehicle can be determined by comparing the absolute value of the difference between the first coordinate Xin and the second coordinate Xout with the determination value J2, and the malfunction of the door opening and closing device 10 can be prevented.

Next, the door opening and closing control performed by the control unit 28 will be described with reference to the flowcharts illustrated in FIGS. 4 to 13.

(Main Flow)

Figure 4:
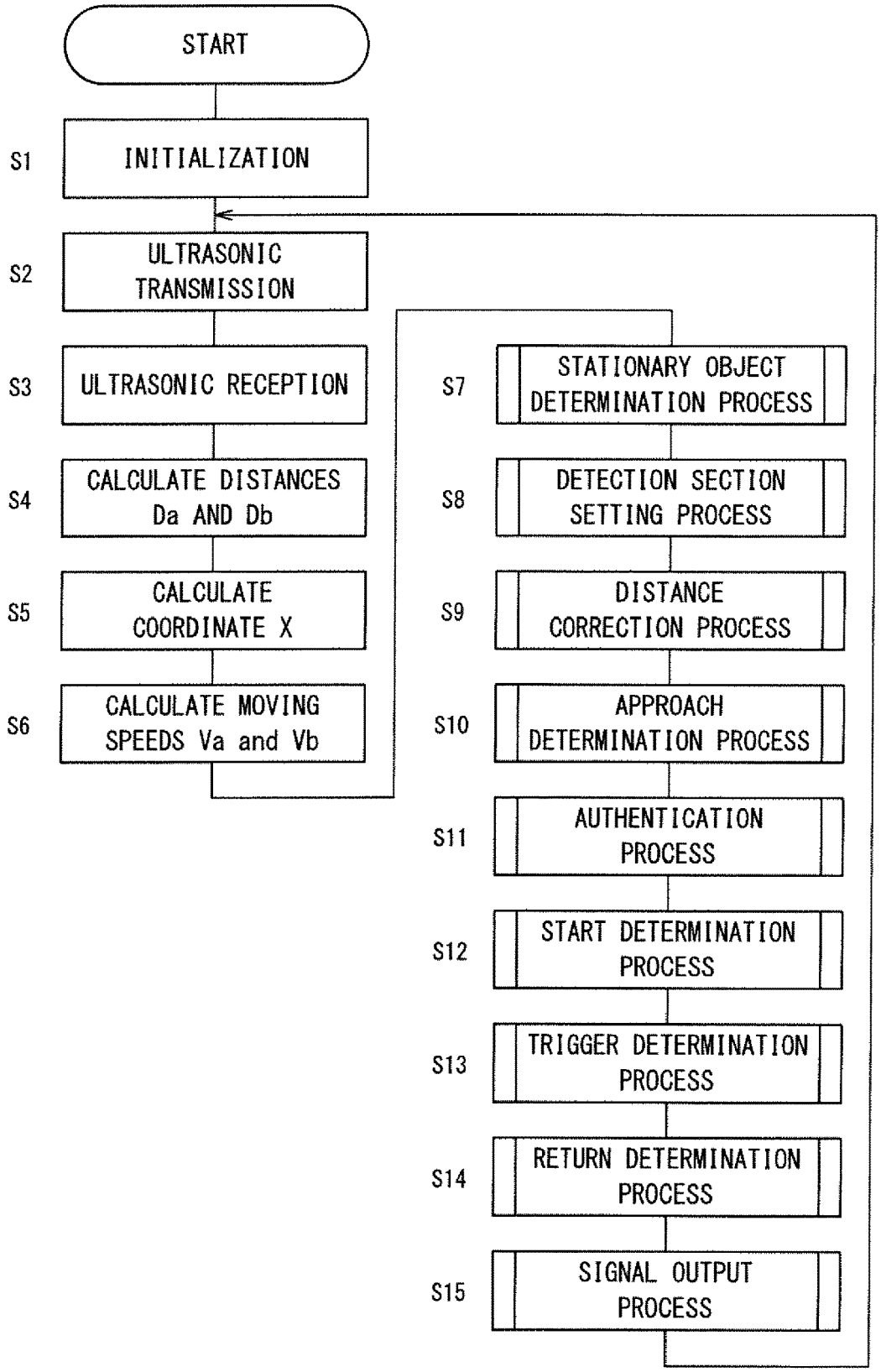
FIG. 4 is a flowchart illustrating main control by a control unit.

The door opening and closing control performed by the control unit 28 is started when the vehicle 1 is parked and the engine is stopped. As illustrated in FIG. 4, in the door opening and closing control, the control unit 28 detects the operations Ma and Mb of the user (Steps S6 to S13), and repeatedly detect the detection target using the detectors 13A and 13B (Steps S2 and S3) until confirming the determination on whether the predetermined operations Ma and Mb have been established or not (Step S14). Then, the door 4 is opened and closed (Step S15) only when the predetermined operations Ma and Mb have been established.

Specifically, the control unit 28 first initializes the storage unit 29 in Step S1, and deletes information performed in the previous door opening and closing control. Subsequently, ultrasonic waves are transmitted from the transmitters 14 of the individual detectors 13A and 13B in Step S2, and reflected waves of the ultrasonic waves are received by the receivers 15 of the individual detectors 13A and 13B in Step S3. Specifically, the ultrasonic wave is transmitted and received by the first detector 13A, and the ultrasonic wave is transmitted and received by the second detector 13B after waiting for a certain time to completely eliminate reverberations of the first detector 13A, thereby preventing erroneous detection between the detectors 13A and 13B.

Subsequently, in Step S4, the distances Da and Db from the individual detectors 13A and 13B to the detection target are calculated based on the detection results (time between the transmission and the reception) of the detectors 13A and 13B. At this time, the same number of detection results corresponding to the number of detection targets are input to the control unit 28, and the measurement unit 30 calculates the distances Da and Db to the detection target using a detection result returned earliest among the input detection results.

Subsequently, the calculation unit 33 calculates the X coordinate of the detection target using the distances Da and Db in Step S5, and then, the moving speeds Va and Vb of the detection target are calculated based on each change amount using the current distances Da and Db and the previous distances Da and Db stored in the storage unit 29 in Step S6. Thereafter, a stationary object determination process is performed using the calculated absolute values of the moving speeds Va and Vb in Step S7. Subsequently, a detection section setting process is performed using the determination results of the moving object and the stationary object in Step S8, and then, a process of correcting the calculated distances Da and Db is performed in Step S9.

Subsequently, an approach determination process of detecting a moving object in the approach area 17 is performed in Step S10, and then, an authentication process is performed to determine whether the moving object is a user in Step S11. Thereafter, in order to detect the operations Ma and Mb of the user, a start determination process is performed in Step S12, a trigger determination process is performed in Step S13, and then, a return determination process is performed in Step S14. When the determination on the establishment of the predetermined operations Ma and Mb is confirmed, a signal output process to open or close the door 4 is executed in Step S15.

(Step S7: Stationary Object Determination Process)

Figure 5:
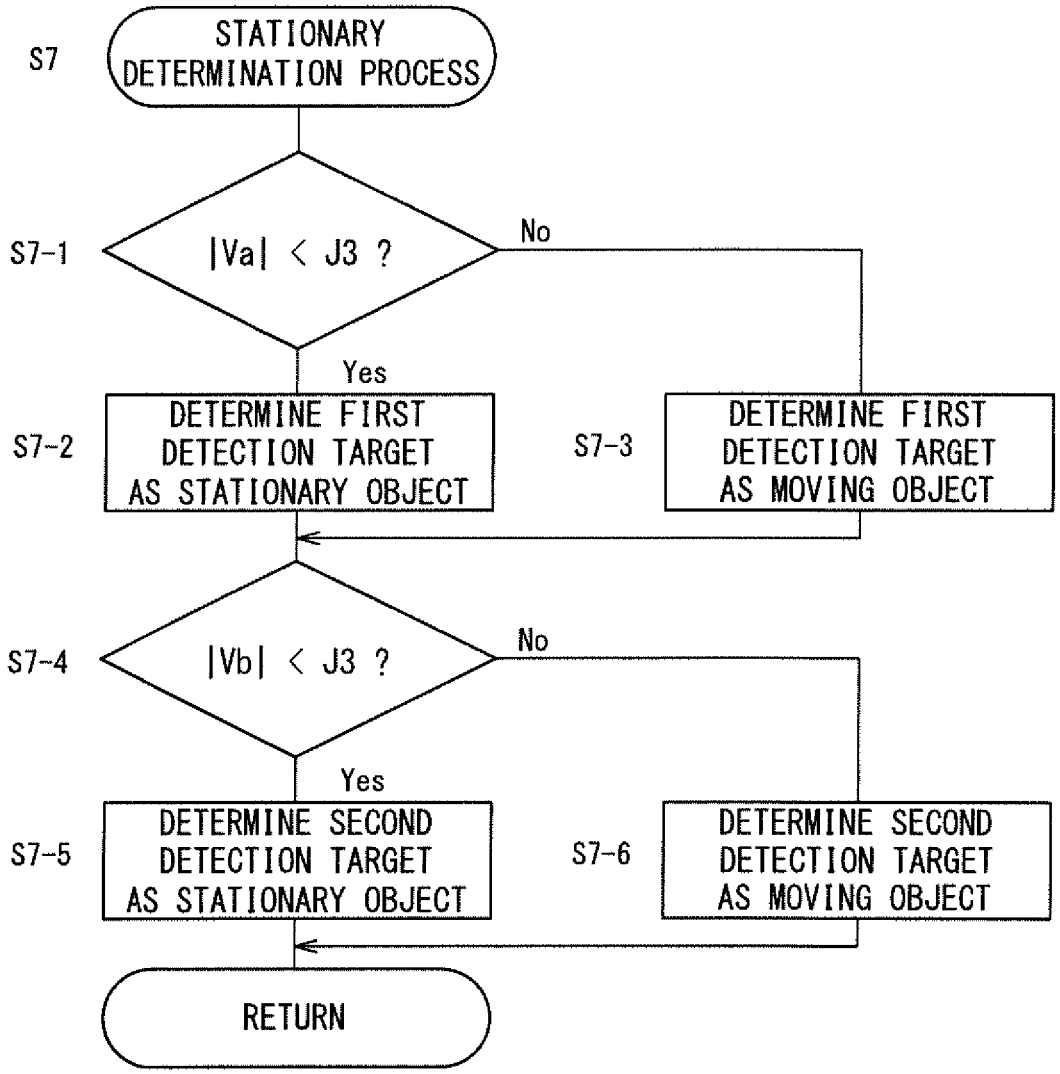
FIG. 5 is a flowchart illustrating a stationary object determination process in FIG. 4.

As illustrated in FIG. 5, in the stationary object determination process, each of the absolute values of the moving speeds Va and Vb of the detection targets calculated in Step S6 is compared with the determination values J3 to determine whether the detection target is the moving object or the stationary object. Then, the detection target determined to be the stationary object is stored in the storage unit 29 together with the distance information.

Specifically, in Step S7-1, the determination unit 31 compares the absolute value of the moving speed Va obtained from the detection result of the first detector 13A with the determination value J3. If the absolute value of the moving speed Va is lower than the determination value J3, it is determined in Step S7-2 that the first detection target is the stationary object. If the absolute value of the moving speed Va is equal to or higher than the determination value J3, it is determined in Step S7-3 that the first detection target is the moving object. Subsequently, in Step S7-4, the determination unit 31 compares the absolute value of the moving speed Vb obtained from the detection result of the second detector 13B with the determination value J3. If the absolute value of the moving speed Vb is lower than the determination value J3, it is determined in Step S7-5 that the second detection target is the stationary object. If the absolute value of the moving speed Vb is equal to or higher than the determination value J3, it is determined in Step S7-6 that the second detection target is the moving object.

(Step S8: Detection Section Setting Process)

Figure 6:
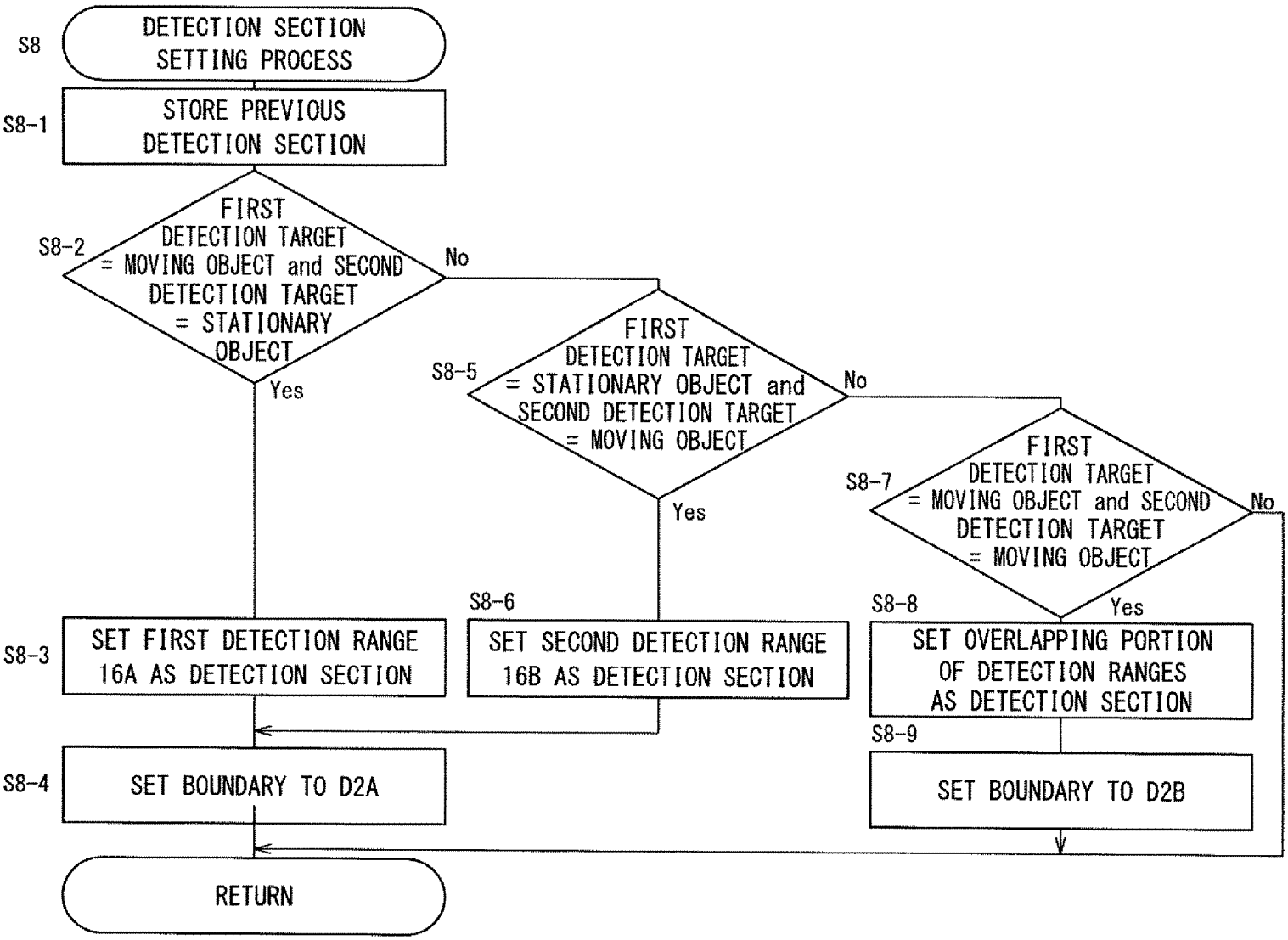
FIG. 6 is a flowchart illustrating a detection section setting process in FIG. 4.

As illustrated in FIG. 6, in the detection section setting process, one of the detection sections 22A to 22C is set and one of the boundary lines 20A and 20B is set based on the determination result on whether the detection target is the moving object or the stationary object obtained by the determination unit 31.

Specifically, the control unit 28 stores the previously set detection sections 22A to 22C in the storage unit 29 in Step S8-1. Subsequently, in Step S8-2, it is determined if the first detection target detected by the first detector 13A indicates the moving object and the second detection target detected by the second detector 13B indicates the stationary object. If such a condition is satisfied, the first detection range 16A is set as the detection section 22A in Step S8-3, and then, a boundary between the start section 18 and the trigger section 19 is set as the boundary line 20A of the set distance D2A (45 cm) in Step S8-4.

If the condition is not satisfied in Step S8-2, the control unit 28 determines if the first detection target detected by the first detector 13A indicates the stationary object and the second detection target detected by the second detector 13B indicates the moving object in Step S8-5. If such a condition is satisfied, the second detection range 16B is set as the detection section 22B in Step S8-6, and then, a boundary between the start section 18 and the trigger section 19 is set as the boundary line 20A in Step S8-4.

If the condition is not satisfied in Step S8-5, the control unit 28 determines if the first detection target detected by the first detector 13A indicates the moving object and the second detection target detected by the second detector 13B also indicates the moving object in Step S8-7. If such a condition is satisfied, an overlapping portion between both the detection ranges 16A and 16B is set as the detection section 22C in Step S8-8, and a boundary between the start section 18 and the trigger section 19 is set as the boundary line 20B of the set distance D2B (60 cm) in Step S8-9

If the condition is not satisfied in Step S8-7, that is, if the first detection target detected by the first detector 13A indicates the stationary object and the second detection target detected by the second detector 13B also indicates the stationary object, the control unit 28 does not change the settings of the detection sections 22A to 22C and the settings of the boundary lines 20A and 20B. As a result, the previous settings are maintained. However, "no setting" may be configured so as not to perform setting in any of the detection sections 22A to 22C.

(Step S9: Distance Correction Process)

Figure 7:
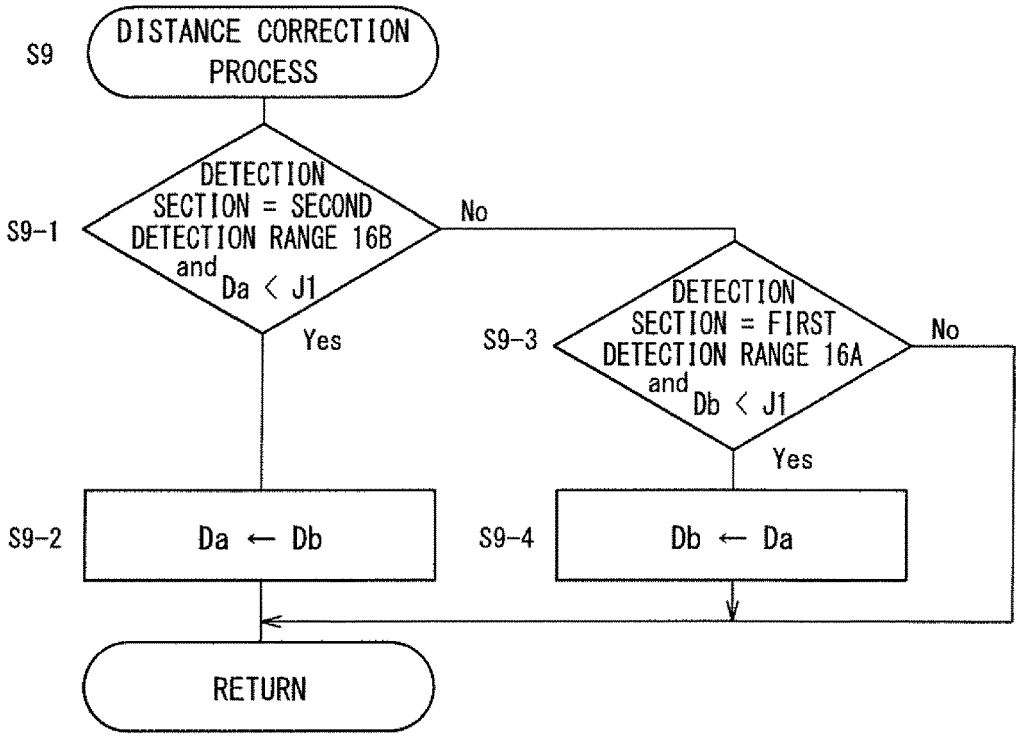
FIG. 7 is a flowchart illustrating a distance correction process in FIG. 4.

As illustrated in FIG. 7, in the distance correction process, the control unit 28 replaces the detection result (distance Da or Db) of the detector 13A or 13B that has detected the wall 6 with the same value as the detection result (distance Db or Da) of the detector 13B or 13A that has detected the moving object when the wall 6 exists around the door 4. As a result, the detected distance to the wall 6 is not used for detection of the moving object.

Specifically, the control unit 28 determines if the second detection range 16B is set as the detection section 22B and the distance Da detected by the first detector 13A is smaller than the determination value J1 (90 cm) in Step S9-1. If such a condition is satisfied, the distance Da detected by the first detector 13A is replaced with the same value as the distance Db detected by the second detector 13B in Step S9-2.

If the condition is not satisfied in Step S9-1, the control unit 28 determines if the first detection range 16A is set as the detection section 22A and the distance Db detected by the second detector 13B is smaller than the determination value J1 (90 cm) in Step S9-3. If such a condition is satisfied, the distance Db detected by the second detector 13B is replaced with the same value as the distance Da detected by the first detector 13A in Step S9-4.

If the condition is not satisfied in Step S9-3, that is, if the wall 6 does not exist around the door 4 or both the detection targets detected by the detectors 13A and 13B are the moving objects, the control unit 28 does not correct (replace) any of the distance Da detected by the first detector 13A and the distance Db detected by the second detector 13B.

(Step S10: Approach Determination Process)

Figure 8:
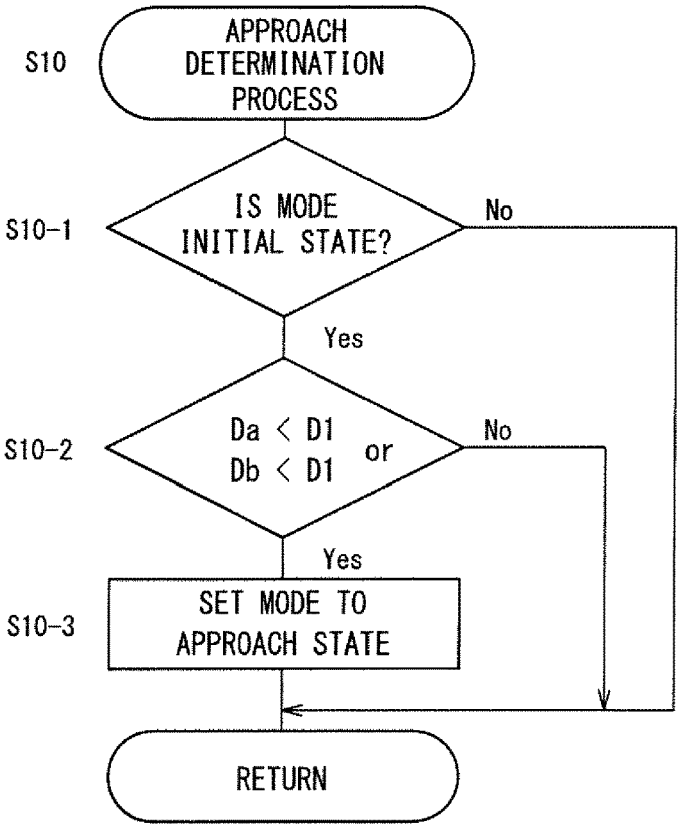
FIG. 8 is a flowchart illustrating an approach determination process in FIG. 4.

As illustrated in FIG. 8, in the approach determination process, the control unit 28 detects whether a moving object including a user and a third party exists in the approach area 17.

Specifically, the control unit 28 determines whether a mode of the door opening and closing control is an initial state in Step S10-1. If the mode is the initial state, it is determined in Step S10-2 whether the distance Da to the moving object detected by the first detector 13A or the distance Db to the moving object detected by the second detector 13B is smaller than the set distance D1 (for example, 120 cm). If the distance Da or Db is smaller than the set distance D1, the mode of the door opening and closing control is set to an approach state, and the process returns in Step S10-3.

On the other hand, when the mode of the door opening and closing control is not the initial state in Step S10-1 and when both the distances Da and Db are equal to or longer than the set distance D1 in Step S10-2, the control unit 28 returns without changing the mode of the door opening and closing control.

(Step S11: Authentication Process)

Figure 9:
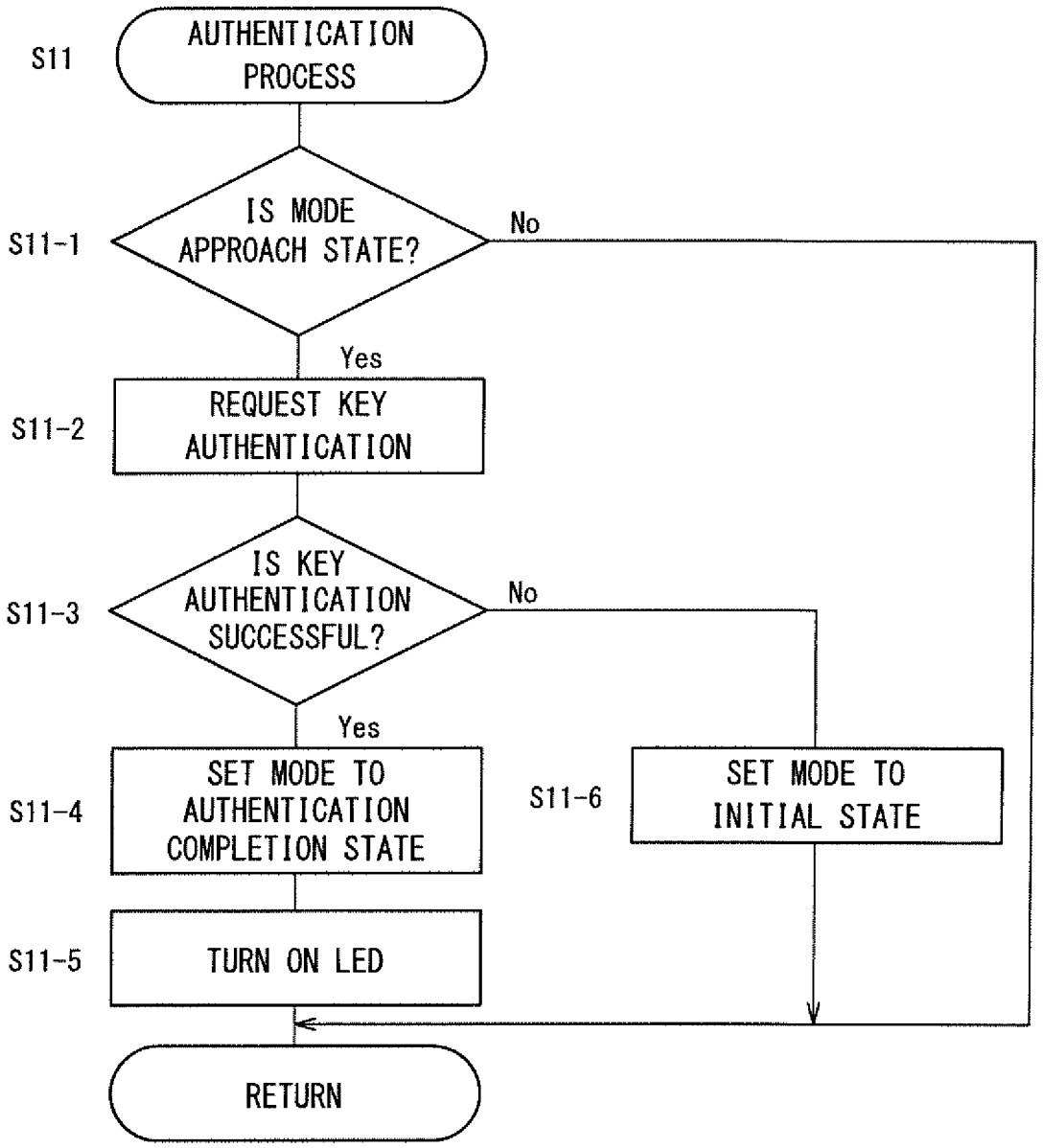
FIG. 9 is a flowchart illustrating an authentication process in FIG. 4.

As illustrated in FIG. 9, in the authentication process, it is determined whether a moving object existing in the approach area 17 is a user or a third party other than the user. If it is determined that the moving object is the user, the mode is shifted to a mode of detecting the predetermined operations Ma and Mb. If it is determined that the moving object is not the user, the mode is returned to the initial state.

Specifically, the control unit 28 determines whether the mode of the door opening and closing control is the approach state in Step S11-1. If the mode is the approach state, the key authentication is requested to the authentication unit 26 in Step S11-2. Thereafter, when it is determined in Step S11-3 that the key authentication has been established (the codes coincide), the mode of the door opening and closing control is set to an authentication completion state in Step S11-4, and the display unit 25 is switched from a turning-off state to a turning-on state in Step S11-5, and the process returns.

On the other hand, if the mode of the door opening and closing control is not the approach state in Step S11-1, the control unit 28 returns without performing the subsequent steps. If it is determined in Step S11-3 that the key authentication is not established (the codes do not coincide), the mode of the door opening and closing control is set to the initial state in Step S11-6, and the process returns.

(Step S12: Start Determination Process)

Figure 10:
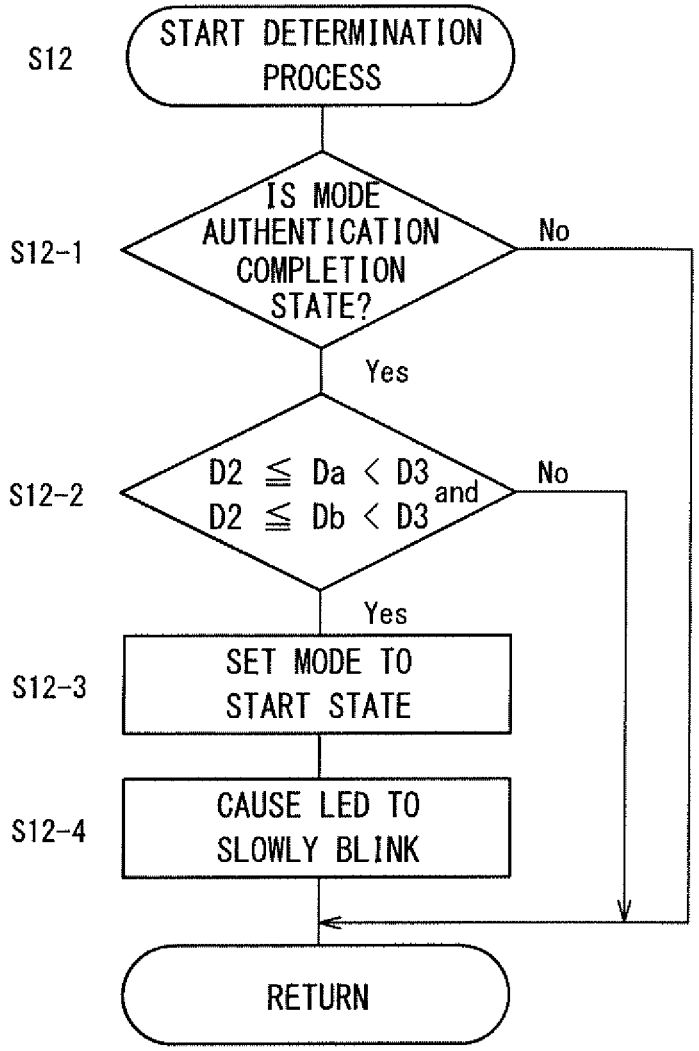
FIG. 10 is a flowchart illustrating a start determination process in FIG. 4.

As illustrated in FIG. 10, in the start determination process, the process stands by until the user moves to the start section 18 in the detection sections 22A to 22C set by the setting unit 32.

Specifically, the control unit 28 determines whether the mode of the door opening and closing control is the authentication completion state in Step S12-1. If the mode is the authentication completion state, it is determined whether both the distances Da and Db to the user detected by the detectors 13A and 13B are equal to or larger than the set distance D2 (D2A and D2B) and smaller than the set distance D3 (for example, 100 cm) in Step S12-2. When such a condition is satisfied, that is, when the user has moved to the start section 18, the mode of the door opening and closing control is set to a start state in Step S12-3, and the display unit 25 is switched from the turning-on state to a slow blinking state in Step S12-4, and the process returns.

On the other hand, if the mode of the door opening and closing control is not the authentication completion state in Step S12-1 and if the condition is not satisfied in Step S12-2, the control unit 28 returns without performing the subsequent steps. Note that the condition of Step S12-2 is not satisfied if the user is located in a place other than the start section 18 in the determined detection sections 22A to 22C.

Here, when the overlapping portion between the detection ranges 16A and 16B is set as the detection section 22C as illustrated in FIG. 2D, both actual detection results (distances Da and Db) of the detectors 13A and 13B satisfy the condition of Step S12-2 if the user moves to the start section 18 (Mb1). On the other hand, when the first detection range 16A is set as the detection section 22A as illustrated in FIG. 2B, the actual detection result (distance Db) of the second detector 13B does not satisfy the condition of Step S12-2 even if the user moves to the start section 18 (Ma1). Further, when the second detection range 16B is set as the detection section 22B as illustrated in FIG. 2C, the actual detection result (distance Da) of the first detector 13A does not satisfy the condition of Step S12-2 even if the user moves to the start section 18 (Ma1). In the present embodiment, however, both the detection results (distances Da and Db) of the corrected detectors 13A and 13B satisfy the condition of Step S12-2 since the detection result (distance Db or Da) has been corrected in the distance correction process of Step S9 in the case of FIGS. 2B and 2C.

(Step S13: Trigger Determination Process)

Figure 11:
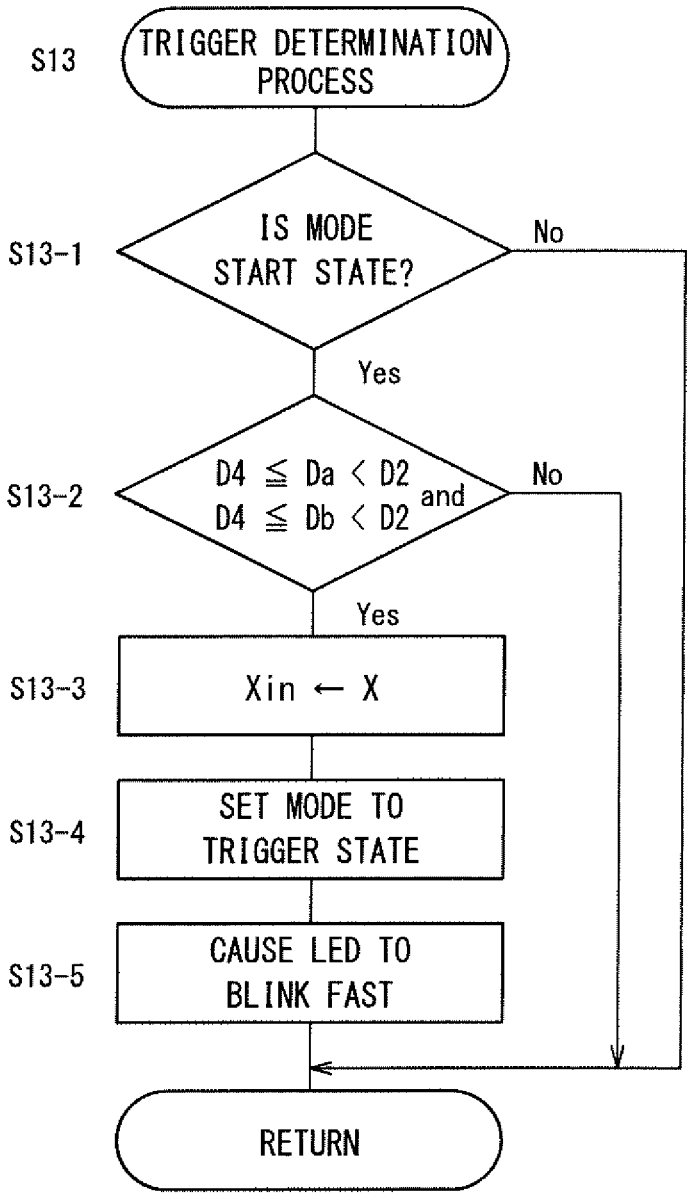
FIG. 11 is a flowchart illustrating a trigger determination process in FIG. 4.

As illustrated in FIG. 11, in the trigger determination process, the control unit 28 stands by until detecting the first motion, that is, until the user moves to the trigger section 19 in the detection sections 22A to 22C set by the setting unit 32.

Specifically, the control unit 28 determines whether the mode of the door opening and closing control is the start state in Step S13-1. If the mode is the start state, it is determined in Steps S13-2 whether both the distances Da and Db to the user detected by the detectors 13A and 13B are equal to or larger than the set distance D4 (for example, 25 cm) and smaller than the set distance D2 (D2A or D2B). If such a condition is satisfied, that is, if the user has moved to the trigger section 19, the X coordinate calculated in Step S5 is stored in the storage unit 29 as the first coordinate Xin in Step S13-3. Thereafter, the mode of the door opening and closing control is set to a trigger state in Step S13-4, and the display unit 25 is switched from the slow blinking state to a fast blinking state in Step S13-5, and the process returns.

On the other hand, if the mode of the door opening and closing control is not the start state in Step S13-1 and if the condition is not satisfied in Step S13-2, the control unit 28 returns without performing the subsequent steps. Note that the condition of Step S13-2 is not satisfied if the user is located in a place other than the trigger section 19 in the determined detection sections 22A to 22C.

When the overlapping portion between the detection ranges 16A and 16B is set as the detection section 22C as illustrated in FIG. 2D, both actual detection results (distances Da and Db) of the detectors 13A and 13B satisfy the condition of Step S13-2 if the user moves to the trigger section 19 (Mb2), which is similar to the case of the above-described start determination process. On the other hand, when the first detection range 16A is set as the detection section 22A as illustrated in FIG. 2B or when the second detection range 16B is set as the detection section 22B as illustrated in FIG. 2C, the actual detection results of the detectors 13A and 13B do not satisfy the condition of Step S13-2 even if the user moves to the trigger section 19 (Ma2). In the present embodiment, however, both the detection results (distances Da and Db) of the corrected detectors 13A and 13B satisfy the condition of Step S13-2 since the detection result (distance Db or Da) has been corrected in the distance correction process of Step S9.

(Step S14: Return Determination Process)

Figure 12:
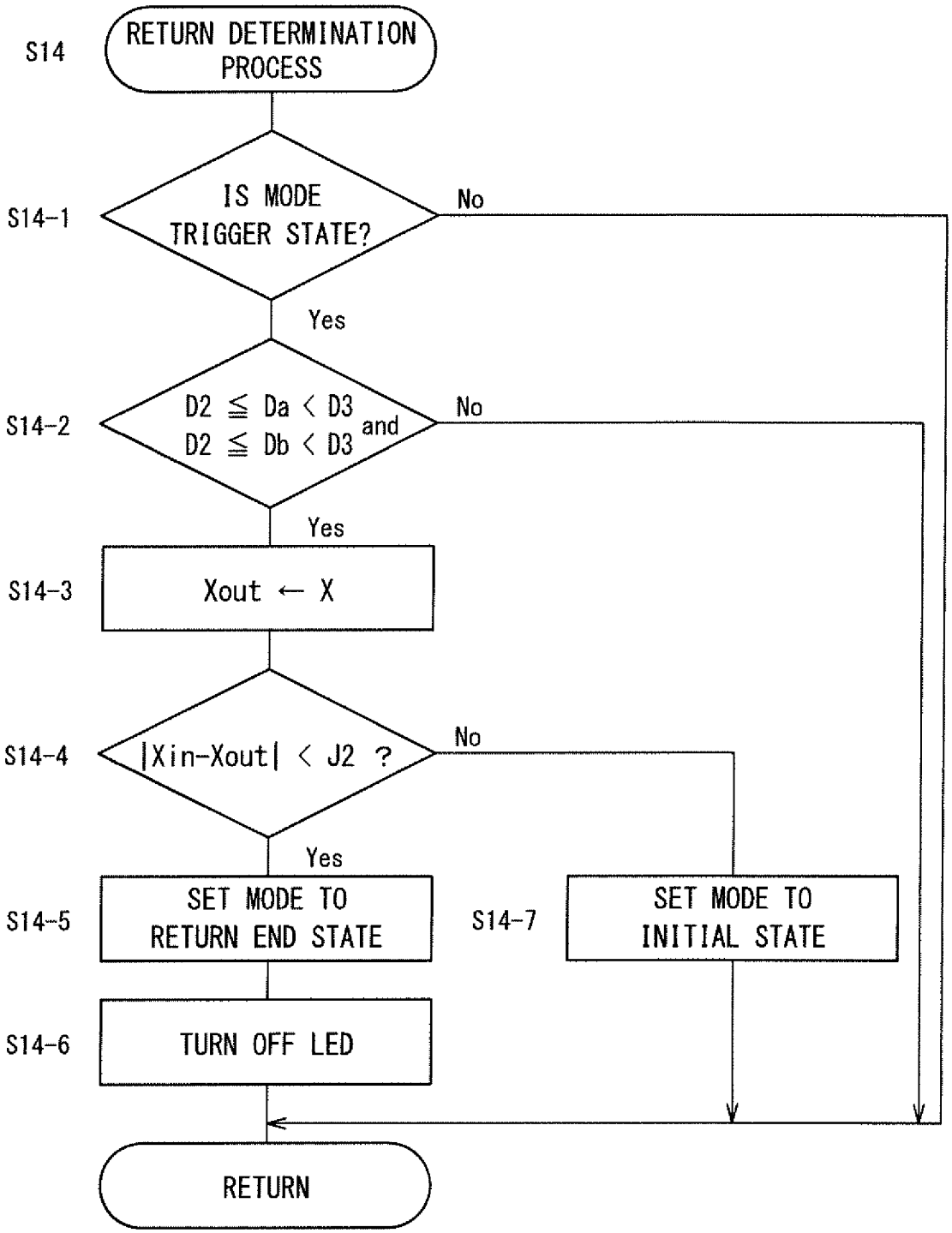
FIG. 12 is a flowchart illustrating a return determination process in FIG. 4.

As illustrated in FIG. 12, in the return determination process, the control unit 28 stands by until detecting the second motion, that is, until the user moves away from the trigger section 19, and determines whether the predetermined operations Ma and Mb are established or not based on a position of the user when moving away from the trigger section 19.

Specifically, the control unit 28 determines whether the mode of the door opening and closing control is the trigger state in Step S14-1. If the mode is the trigger state, it is determined whether both the distances Da and Db to the user detected by the detectors 13A and 13B are equal to or larger than the set distance D2 (D2A and D2B) and smaller than the set distance D3 (for example, 100 cm) in Step S14-2. If such a condition is satisfied, that is, if the user moves away from the trigger section 19, the X coordinate calculated in Step S5 is stored in the storage unit 29 as the second coordinate Xout in Step S14-3.

Subsequently, it is determined in Step S14-4 whether an absolute value of a distance obtained by subtracting the second coordinate Xout from the first coordinate Xin is smaller than the determination value J2 (for example, 30 cm). If such a condition is satisfied, that is, if the user moves to the start section 18, the mode of the door opening and closing control is set to a return end state in Step S14-5, and the display unit 25 is switched from the fast blinking state to the turning-off state in Step S14-6, and the process returns. If the condition is not satisfied in Step S14-4, the mode of the door opening and closing control is set to the initial state in Step S14-7, and the process returns.

On the other hand, if the mode of the door opening and closing control is not the trigger state in Step S14-1 and if the condition is not satisfied in Step S14-2, the control unit 28 returns without performing the subsequent steps. Note that the condition of Step S14-2 is not satisfied unless the user moves away from the defined trigger section 19 in the detection sections 22A to 22C.

Here, when the overlapping portion between the detection ranges 16A and 16B is set as the detection section 22C as illustrated in FIG. 2D, both actual detection results (distances Da and Db) of the detectors 13A and 13B satisfy the condition of Step S14-2 if the user moves to the start section 18 (Mb3). Further, when the wall 6 does not exist around the door 4, there is almost no movement of the user in the vehicle width direction since the predetermined operation Mb is a series of behaviors of moving forward and backward in the direction orthogonal to the door 4. Therefore, both the actual detection results (distances Da and Db) of the detectors 13A and 13B satisfy the condition of Step S14-4.

On the other hand, when the first detection range 16A is set as the detection section 22A as illustrated in FIG. 2B or when the second detection range 16B is set as the detection section 22B as illustrated in FIG. 2C, the actual detection results (distances Da and Db) of the detectors 13A and 13B do not satisfy the condition of Step S14-2 even if the user moves to the start section 18 (Ma3). In the present embodiment, however, both the detection results of the corrected detectors 13A and 13B satisfy the condition of Step S14-2 since the detection result (distance Db or Da) has been corrected in the distance correction process of Step S9.

When the wall 6 exists around the door 4, the predetermined operation Ma is a series of behaviors of moving forward and backward along the door 4. A movement amount when the user returns to the start section 18 (Ma3) after the user moves from the start section 18 to the trigger section 19 (Ma2) is smaller than a movement amount when the user passes the vehicle (Ma4). In the former case, both the corrected detection results (distances Da and Db) of the detectors 13A and 13B satisfy the condition of Step S14-4. In the latter case, however, the corrected detection results (distances Da and Db) of the detectors 13A and 13B do not satisfy the condition of Step S14-4. Therefore, it is possible to reliably determine the motion of returning to the start section 18 in the defined detection section 22A or 22B and the motion in the case of passing the vehicle.

(Step 815: Signal Output Process)

Figure 13:
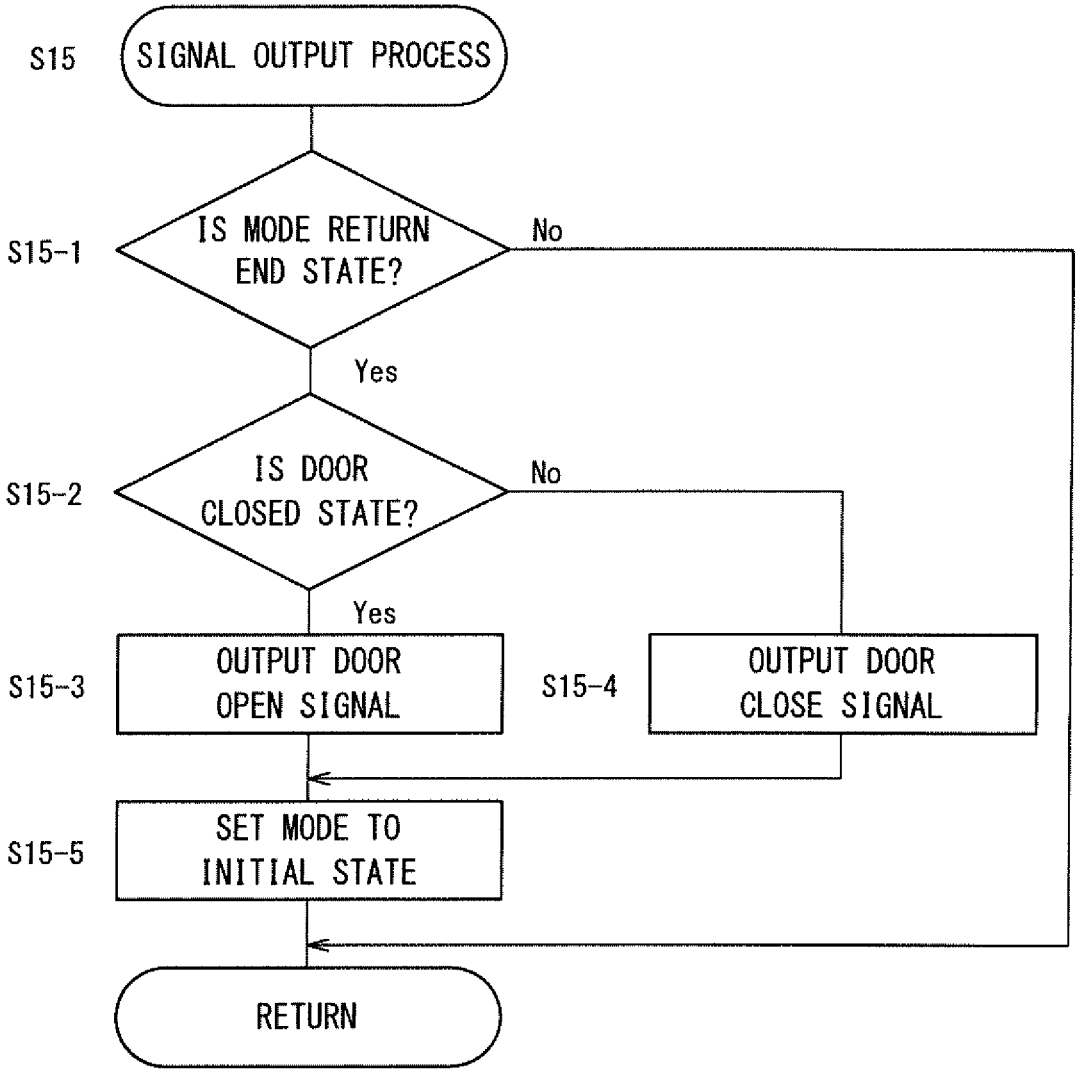
FIG. 13 is a flowchart illustrating a signal output process in FIG. 4.

As illustrated in FIG. 13, in the signal output process, the drive unit 24 is operated for opening in the state where the door 4 is closed, and the drive unit 24 is operated for closing in the state where the door 4 is open.

Specifically, the control unit 28 determines whether the mode of the door opening and closing control is the return end state in Step S15-1. If the mode is in the return end state, it is determined in Step S15-2 whether the door 4 is in the closed state based on a signal from a detection switch (not illustrated) or the like. If the door 4 is in the closed state (see FIG. 3A), a door open signal is output to the drive unit 24 in Step S15-3. If the door 4 is in the open state (see FIG. 3B), a door close signal is output to the drive unit 24 in Step S15-4. Thereafter, the mode of the door opening and closing control is set to the initial state in Step S15-5, and the process returns.

On the other hand, if the mode of the door opening and closing control is not the return end state in Step S15-1, the control unit 28 returns without performing the subsequent steps.

The door opening and closing device 10 of the present embodiment configured as described above has the following features.

The predetermined operation Ma includes the first motion (first stage) from the start section 18 to the trigger section 19 and the second motion (final stage) from the trigger section 19 to the start section 18. Therefore, the predetermined operation Ma of the user can be reliably detected. Further, the boundary lines 20A and 20B between the start section 18 and the trigger section 19 are distinguished between the case where the wall 6 exists around the door 4 and the case where the wall 6 does not exist. Therefore, the movement of the user can be reliably detected even if the empty area around the door 4 is narrow due to the wall 6. Further, it is individually determined whether the detection target is the moving object or the stationary object based on the changes of the distances Da and Db for the predetermined period detected by the detectors 13A and 13B, and thus, the moving object and the stationary object can be reliably determined.

If the distance to the stationary object is shorter than the first determination value J1, the first motion of the predetermined operation Ma is detected using only the distance Da or Db of one the first detector 13A and the second detector 13B that has detected the moving object. Specifically, only the distance Da detected by the first detector 13A is used to detect the first motion when the first detector 13A detects the moving object and the second detector 13B detects the stationary object, and only the distance Db detected by the second detector 13B is used to detect the first motion when the first detector 13A detects the stationary object and the second detector 13B detects the moving object. Therefore, a space (distance) for the user to perform the predetermined operation Ma can be secured even if the free space around the door 4 is narrow due to the presence of the wall 6, and thus, the door 4 can be opened and closed. Further, it is possible to reduce cost of the door opening and closing device 10 as compared with a case where a detector different from the first detector 13A and the second detector 13B is added.

When the first detection target detected by the first detector 13A is the moving object and the second detection target detected by the second detector 13B is the stationary object, the distance Db detected by the second detector 13B is replaced with the same value as the distance Da detected by the first detector 13A. Further, when the first detection target detected by the first detector 13A is the stationary object and the second detection target detected by the second detector 13B is the moving object, the distance Da detected by the first detector 13A is replaced with the same value as the distance Db detected by the second detector 13B. Therefore, there is no need to perform different control between the case where only the distance detected by one of the two detectors 13A and 13B is used and the case where the distances detected by the both are used, and the door 4 can be opened and closed with the same program. As a result, the program relating to the door opening and closing control can be simplified, and the cost can be reduced.

Since the setting unit 32, which sets the first detection range 16A as the detection section 22A when the first detection target detected by the first detector 13A is the moving object and the second detection target detected by the second detector 13B is the stationary object, and sets the second detection range 16B as the detection section 22B when the first detection target detected by the first detector 13A is the stationary object and the second detection target detected by the second detector 13B is the moving object, is provided, the operation Ma of the user can be reliably detected.

The calculation unit 33, which calculates the coordinate of the moving object using the distance Da detected by the first detector 13A and the distance Db detected by the second detector 13B, is provided. The control unit 28 compares the absolute value of the difference between the first coordinate Xin obtained at the time of performing the stage (first motion) preceding the final stage out of the predetermined operation Ma and the second coordinate Xout obtained at the time of performing the final step (second motion) with the second determination value J2 to determine whether the predetermined operation Ma is established or not. Therefore, it is possible to effectively prevent the malfunction in which the door 4 is opened and closed by the passage of the user in the vehicle width direction.

Second Embodiment

Figure 14:
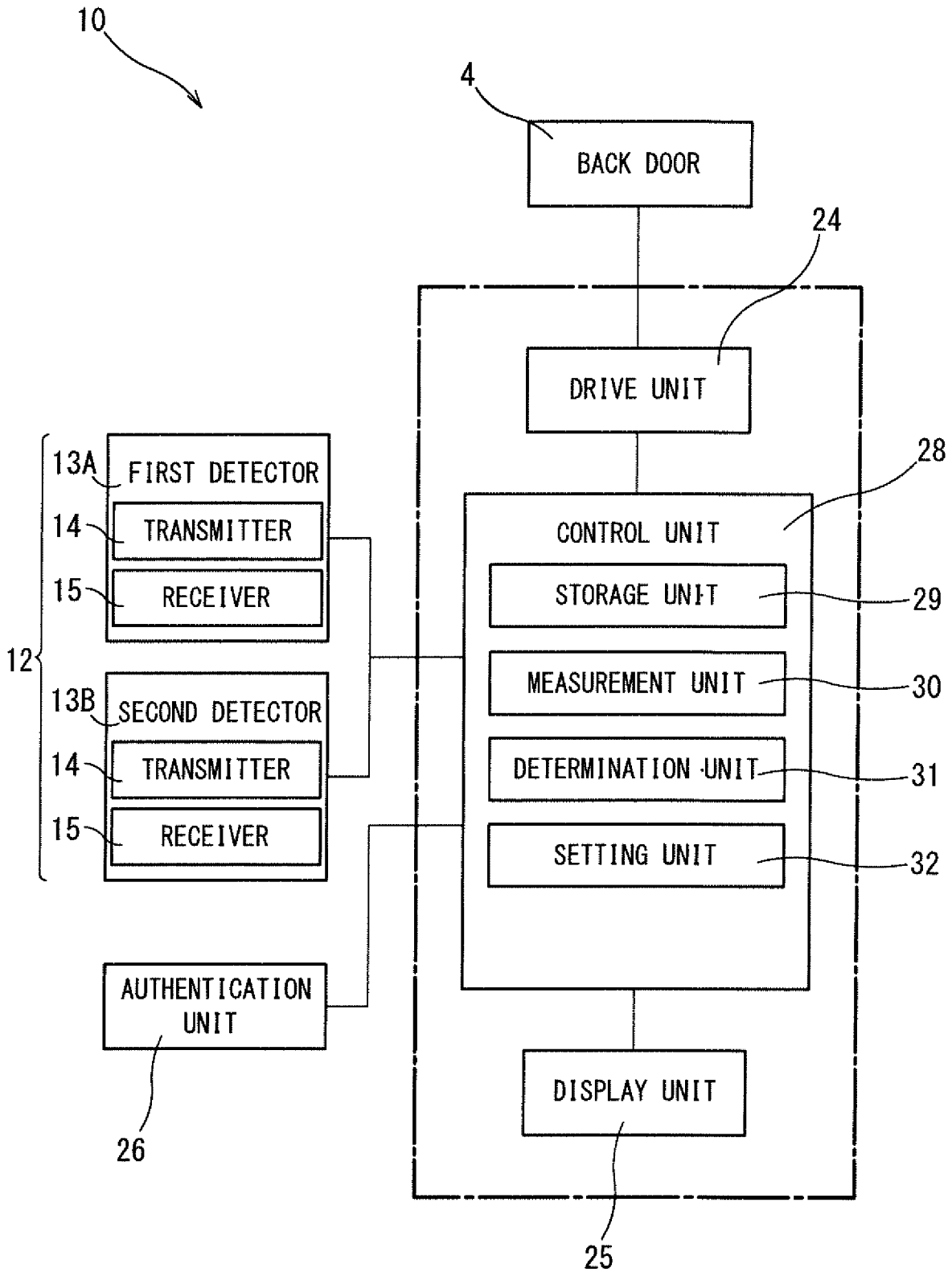
FIG. 14 is a block diagram illustrating a door opening and closing device according to a second embodiment.
Figure 15A:
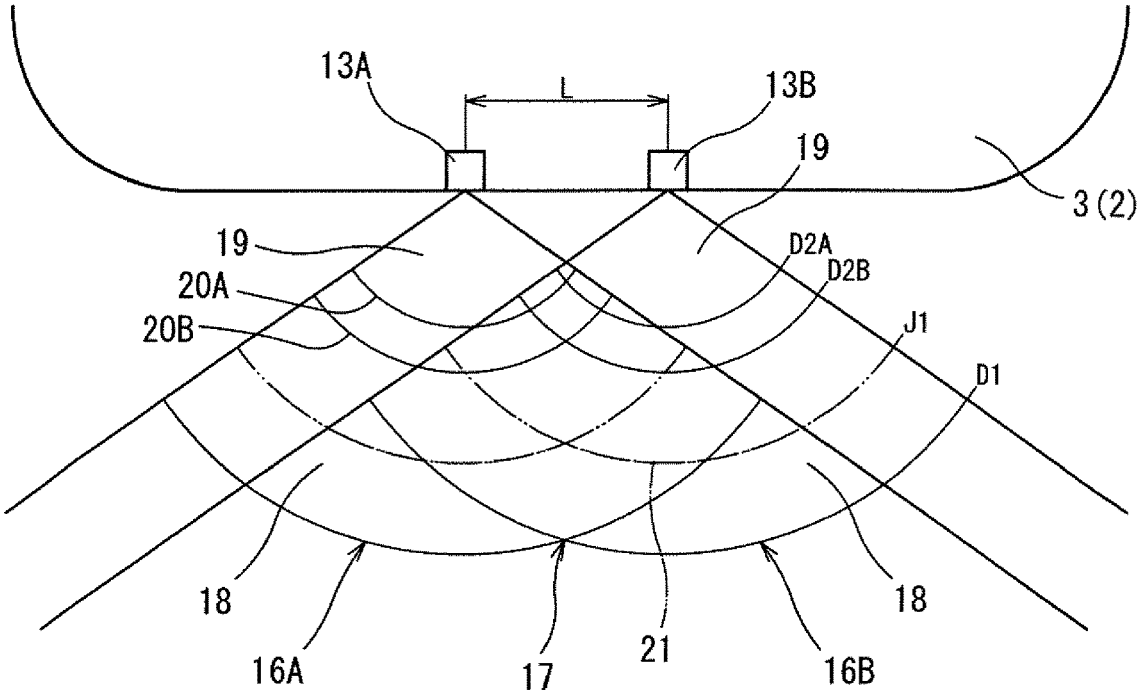
FIG. 15A is a plan view illustrating a detection range according to the second embodiment.

FIGS. 14 and 15A illustrate the door opening and closing device 10 according to a second embodiment. The second embodiment is different from the first embodiment in terms that the control unit 28 does not include a calculation unit as illustrated in FIG. 14, and an interval L between the first detector 13A and the second detector 13B is wider than that in the first embodiment as illustrated in FIG. 15A. The other configurations are the same as those of the first embodiment.

An overlapping portion between the first detection range 16A and the second detection range 16B is reduced (narrower) as the interval L between the first detector 13A and the second detector 13B becomes wider, and is increased (wider) as the interval L becomes narrower. Since the interval L in the second embodiment is wider than the interval L in the first embodiment, an area in which a detection target can be detected by both the detectors 13A and 13B is smaller than that in the first embodiment. Therefore, an area in which a coordinate at the time of performing the first motion (first stage) (Ma2 or Mb2) out of the predetermined operations Ma and Mb and a coordinate at the time of performing the second motion (final stage) (Ma3 or Mb3) can be calculated becomes narrower, and thus, hardly appears as a difference in coordinates. Therefore, it is difficult to determine whether the predetermined operations Ma and Mb are established or not based on the difference in coordinates.

Therefore, the determination on the establishment of the predetermined operations Ma and Mb is performed by comparing the detection sections 22A to 22C in the door opening and closing control of the second embodiment. Specifically, the control unit 28 compares detection sections (first detection sections) 22A to 22C at the time of performing the first motion (Ma2 or Mb2) and detection sections (second detection sections) 22A to 22C at the time of performing the second motion. Then, it is determined that the predetermined operations Ma and Mb are established when the first detection sections 22A to 22C and the second detection sections 22A to 22C are the same, and it is determined that the predetermined operations Ma and Mb are not established when the first detection sections 22A to 22C are different from the second detection sections 22A to 22C. As a result, the malfunction in which the door 4 is opened and closed by the passage of the user is prevented.

Figure 15B:
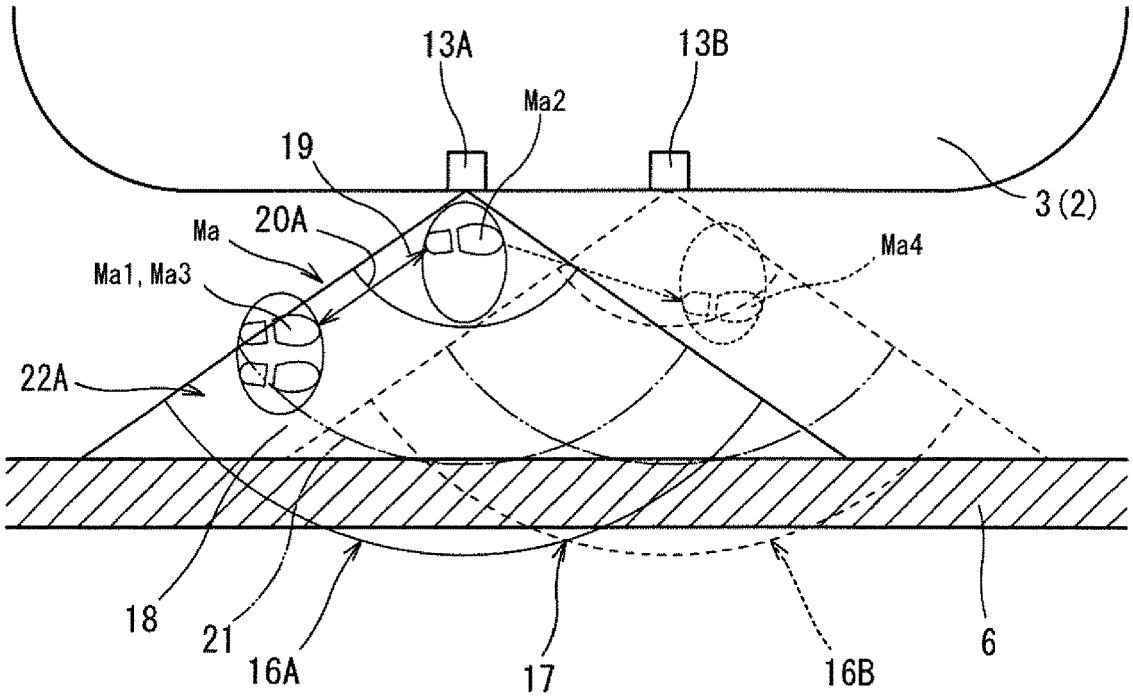
FIG. 15B is a plan view illustrating a state where a wall exists around a door and a first detection range is set as a detection section.
Figure 15C:
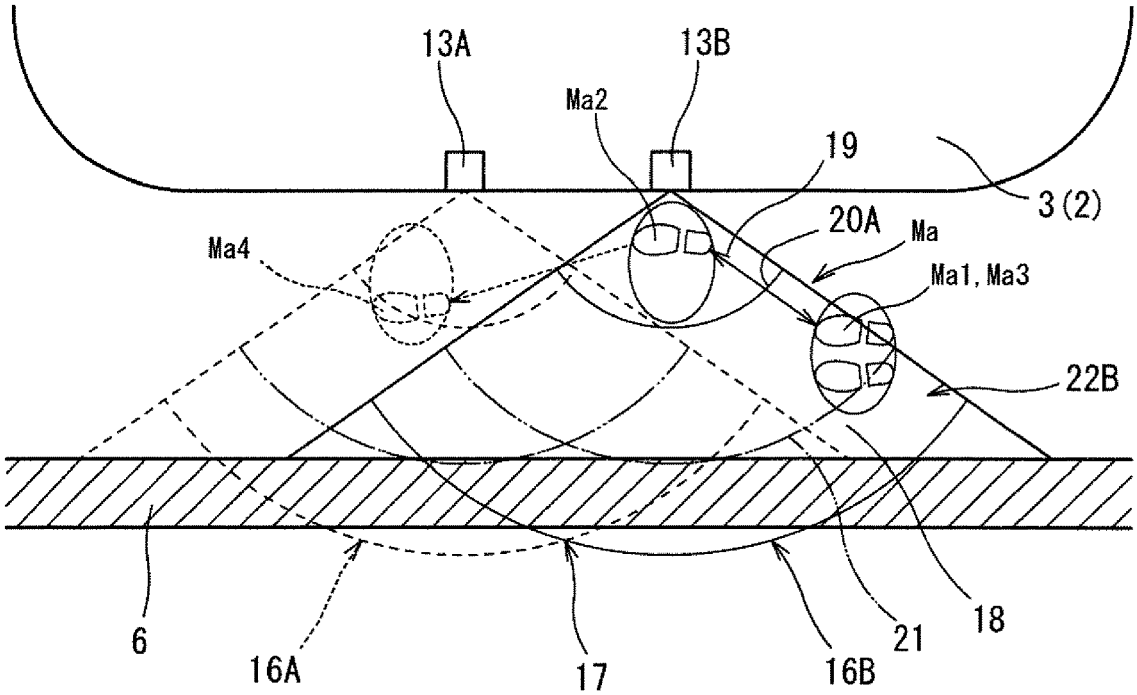
FIG. 15C is a plan view illustrating a state where the wall exists around the door and a second detection range is set as a detection section.

As illustrated in FIGS. 15B and 15C, the motion of the user when passing behind the vehicle 1 is linear (Ma1, Ma2, or Ma4), and the speed thereof is faster than those of the motions Ma1, Ma2 and Ma3 of moving forward and backward. Therefore, when the user passes the vehicle, the user moves from one of the detection ranges 16A and 16B to the other. Therefore, whether or not the user passes the vehicle can be determined by comparing the detection sections 22A and 22B of Ma2 at the time of performing the first motion and the detection sections 22A and 22B of Ma3 or Ma4 at the time of performing the second motion.

Figure 15D:
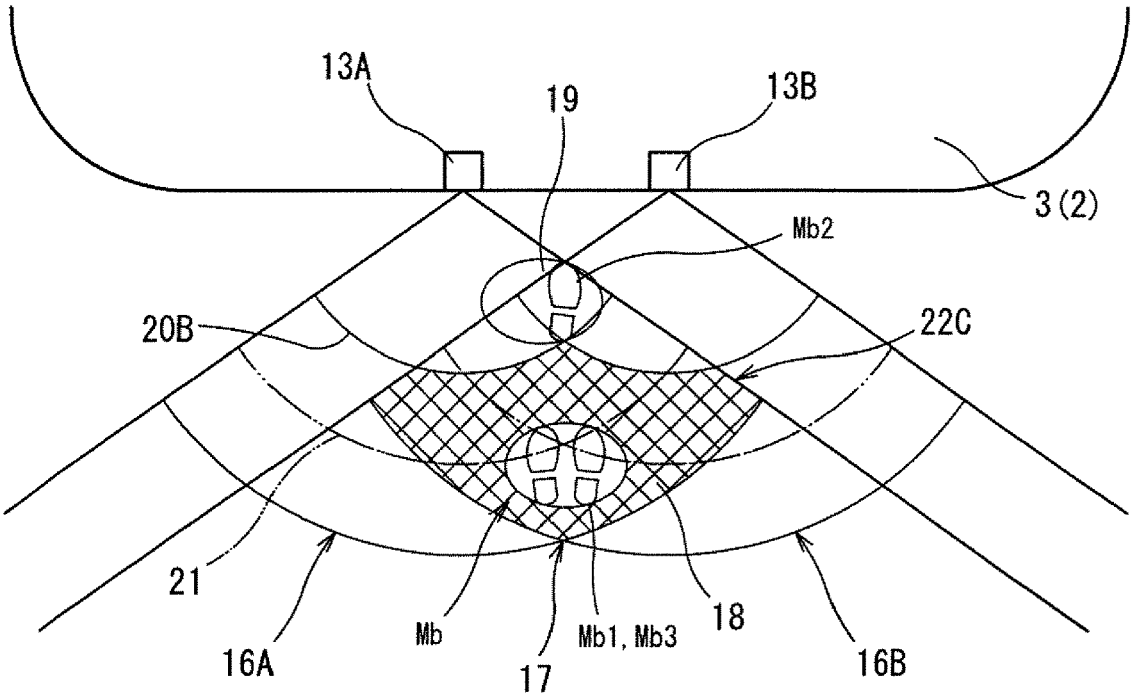
FIG. 15D is a plan view illustrating a detection range and a detection section when there is no wall around the door.

As illustrated in FIG. 15D, when the wall 6 does not exist around the door 4, the predetermined operation Mb is forward and backward movement in a direction orthogonal to the door 4, there is almost no movement of the user in the vehicle width direction. On the other hand, when the user approaches from behind and moves sideways, the setting made by the setting unit 32 changes from the detection section 22C to the detection section 22A or 22B. Therefore, even when the overlapping portion is set as the detection section 22C, whether or not the user passes the vehicle can be determined by the comparison with the second detection sections 22A to 22C after performing the first motion, and the malfunction of the door opening and closing device 10 can be prevented.

Next, door opening and closing control according to the second embodiment performed by the control unit 28 will be described with reference to the flowcharts illustrated in FIGS. 16 to 18.

Figure 16:
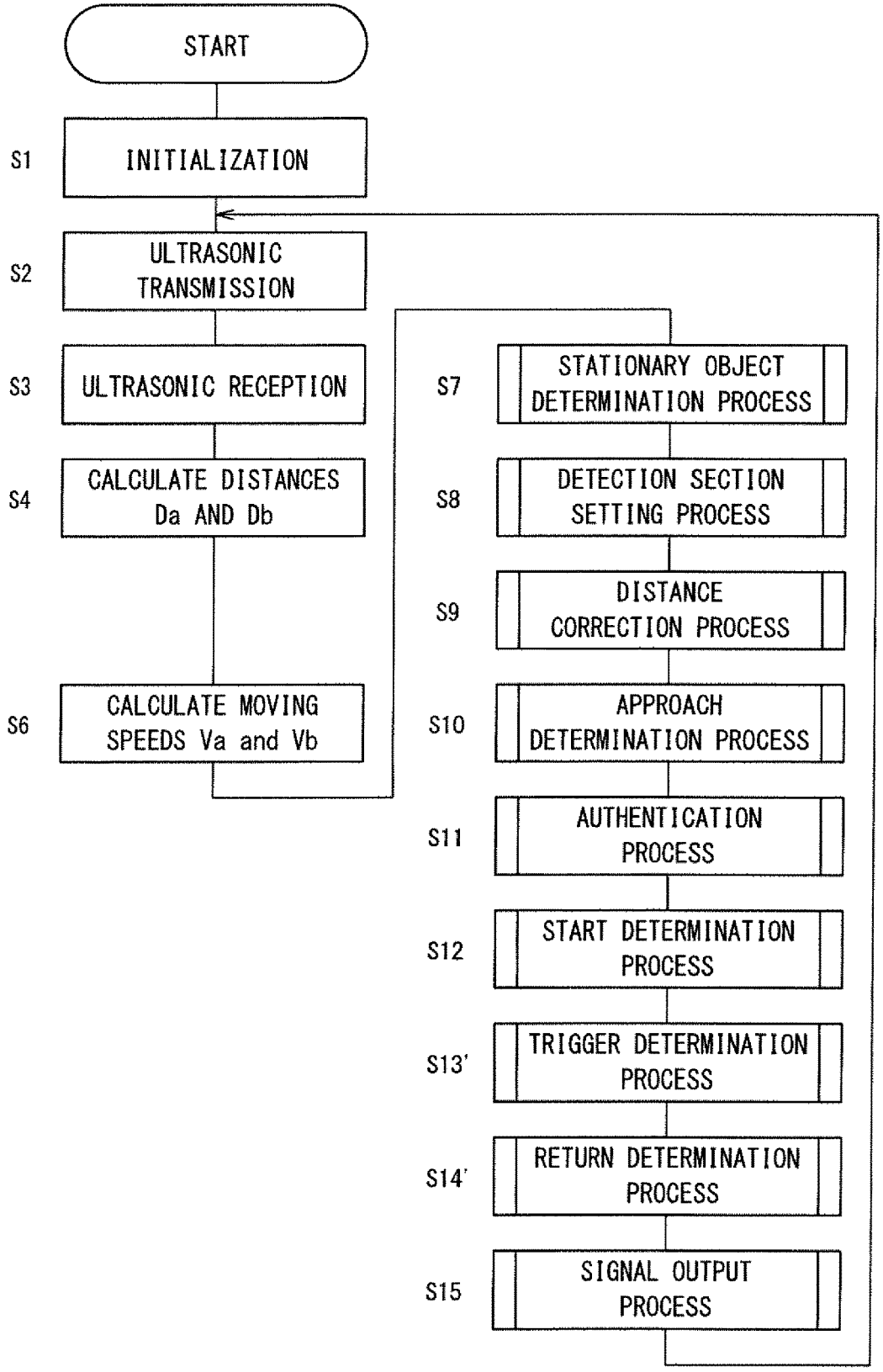
FIG. 16 is a flowchart illustrating main control by a control unit according to the second embodiment.

Referring to FIG. 16 in conjunction with FIG. 4, the main flow of the second embodiment is different from that of the first embodiment in terms that the calculation of the X coordinate of the detection target in Step S5 has been eliminated, a part of the trigger determination process in Step S13 has been changed, and a part of the return determination process in Step S14 has been changed. The other points are the same as those in the first embodiment.

That is, the distances Da and Db from the individual detectors 13A and 13B to the detection targets are calculated based on the detection results of the detectors 13A and 13B in Step S4, and then, the current distances Da and Db and the previous distances Da and Db stored in the storage unit 29 are used to calculate the moving speeds Va and Vb of the detection targets from each change amount thereof in Step S6. Note that an average inclination (a change rate of the distance) of detection results for a predetermined number of times may be calculated as the moving speeds Va and Vb, which is similar to the first embodiment.

Figure 17:
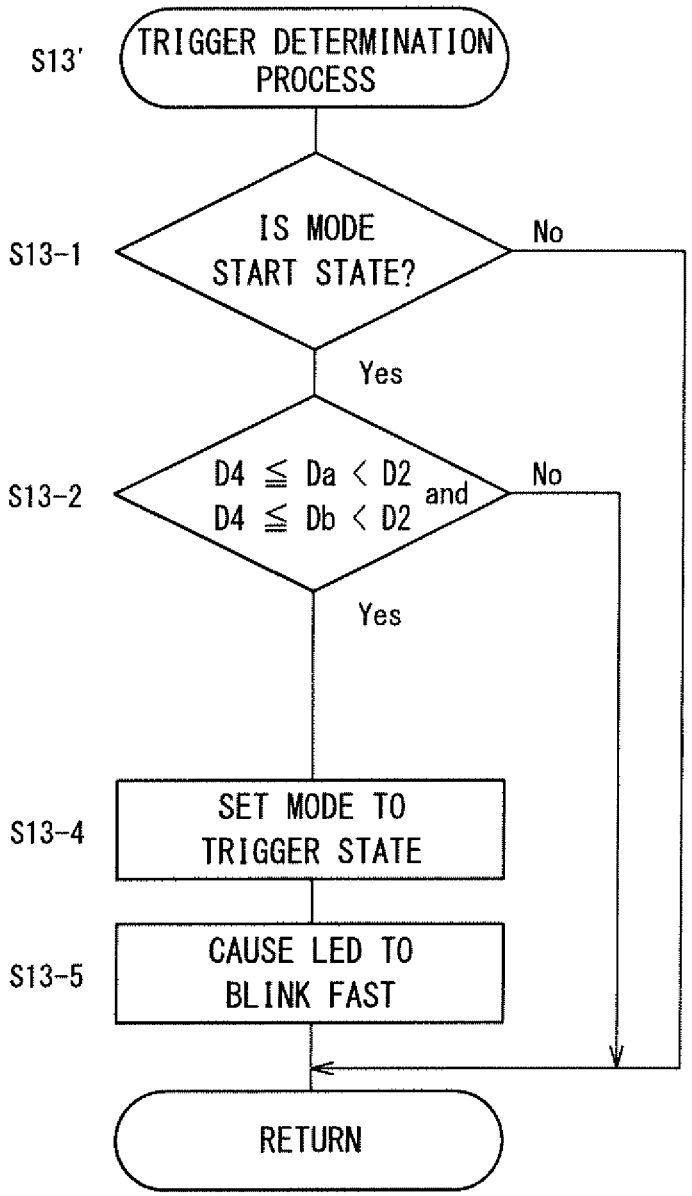
FIG. 17 is a flowchart illustrating a trigger determination process in FIG. 16.

Referring to FIG. 17 in conjunction with FIG. 11, a trigger determination process (Step S13') of the second embodiment is different from the first embodiment in terms that Step S13-3 of storing the first coordinate Xin in the storage unit 29 has been eliminated. The other points are the same as those in the first embodiment. That is, when the condition is satisfied in Step S13-2, the mode of the door opening and closing control is set to the trigger state in Step S13-4 without storing the first coordinate Xin.

Figure 18:
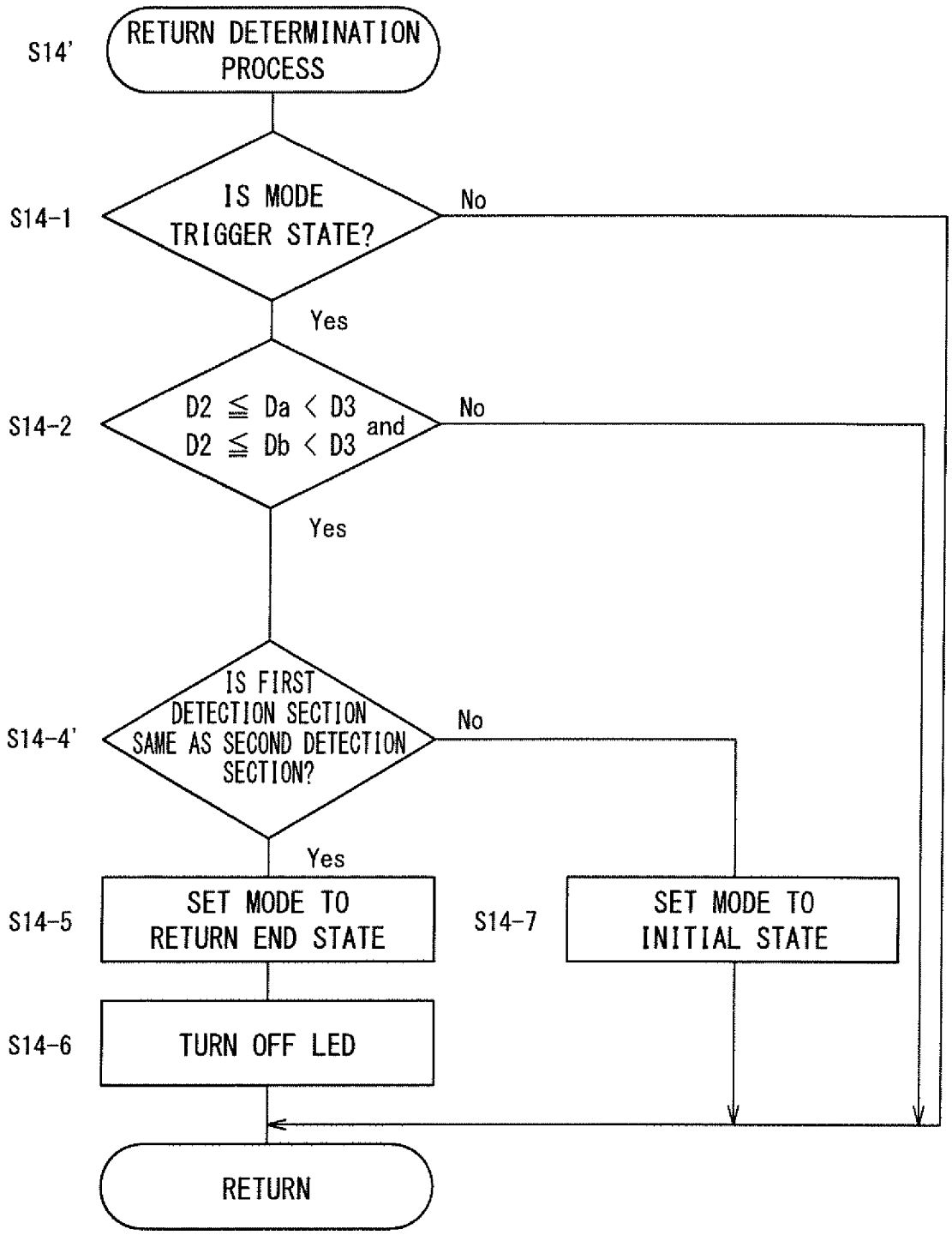
FIG. 18 is a flowchart illustrating a return determination process in FIG. 16.

Referring to FIG. 18 in conjunction with FIG. 12, a return determination process (Step S14') of the second embodiment is different from the first embodiment in terms that Step S14-3 of storing the second coordinate Xout in the storage unit 29 has been eliminated and the detection sections 22A to 22C are compared instead of the coordinates in Step S14-4'. The other points are the same as those in the first embodiment.

That is, if the condition is satisfied in Step S14-2, the first detection sections 22A to 22C at the time of performing the first motion (Ma2 or Mb2) are compared with the second detection sections 22A to 22C at the time of moving away from the first detection sections 22A to 22C (Ma3 and Mb3 or Ma4 and Mb4) in Step S14-4' without storing the second coordinate Xout. Then, the mode of the door opening and closing control is set to the return end state in Step S14-5 if the first detection sections 22A to 22C are the same as the second detection sections 22A to 22C, and the mode of the door opening and closing control is set to the initial state in Step S14-7 if the first detection sections 22A to 22C are different from the second detection sections 22A to 22C.

In the door opening and closing device 10 of the second embodiment configured as above, the movement of the user can be reliably detected regardless of the presence or absence of the wall 6 around the door 4, which is similar to the first embodiment. Further, it is possible to determine whether the predetermined operations Ma and Mb are established or not depending on whether the first detection sections 22A to 22C at the time of performing the first motion (the stage preceding the final stage) coincide with the second detection sections 22A to 22C at the time of performing the second motion (the final stage). Therefore, it is possible to prevent the door 4 from being opened and closed by the motion of the user passing in the vehicle width direction.

Note that the door opening and closing device 10 of the present invention is not limited to the configurations of the above embodiments, and various modifications can be made.

For example, a part of the existing back sonar sensor has been used for the detectors 13A and 13B of the detection unit 12 that detects the detection target, but a dedicated ultrasonic sensor may be arranged. Further, the detectors 13A and 13B are not limited to the ultrasonic sensors, and can be changed if necessary as long as the sensors can measure the distance to the detection target.

The door 4 controlled by the door opening and closing device 10 may be a hinged door for getting on and off a vehicle or a sliding door that is arranged on a side surface of the vehicle body 2.

What is claimed is:

1. A door opening and closing device comprising:

a driving unit that opens and closes a door with respect to a vehicle body;

a first detector and a second detector that are arranged on the vehicle body with an interval in a horizontal direction and repeatedly detect distances to detection targets including a moving object and a stationary object around the door, respectively; and a control unit that opens and closes the door using the drive unit when detecting a predetermined operation performed by the moving object and having a plurality of stages based on a detection result of the first detector and a detection result of the second detector, wherein the control unit determines whether a first detection target, which is the detection target detected by the first detector, is the moving object or the stationary object based on the detection result of the first detector, and determines whether a second detection target, which is the detection target detected by the second detector, is the moving object or the stationary object based on the detection result of the second detector, and when one of the first detection target and the second detection target is the moving object and the other is the stationary object and a distance to the stationary object is shorter than a first determination value, both the detection result of the first detector and the detection result of the second detector are used for detection at a final stage among the plurality of stages, and only the detection result of the one of the first detector and the second detector that has detected the moving object is used for detection at stages other than the final stage.

2. The door opening and closing device according to claim 1, wherein the control unit determines whether the first detection target detected by the first detector is the moving object or the stationary object depending on a change of the distance detected by the first detector for a predetermined period, and determines whether the second detection target detected by the second detector is the moving object or the stationary object depending on a change of the distance detected by the second detector for a predetermined period.

3. The door opening and closing device according to claim 1, wherein the control unit uses only the distance detected by the first detector for detection at stages other than the final stage when the first detection target detected by the first detector is the moving object and the second detection target detected by the second detector is the stationary object, and uses only the distance detected by the second detector for detection at stages other than the final stage when the first detection target detected by the first detector is the stationary object and the second detection target detected by the second detector is the moving object.

4. The door opening and closing device according to claim 1, wherein the control unit replaces the distance detected by the second detector with a value identical to the distance detected by the first detector when the first detection target detected by the first detector is the moving object and the second detection target detected by the second detector is the stationary object, and replaces the distance detected by the first detector with a value identical to the distance detected by the second detector when the first detection target detected by the first detector is the stationary object and the second detection target detected by the second detector is the moving object.

5. The door opening and closing device according to claim 1, further comprising a setting unit that sets any of a first detection range of the first detector and a second detection range of the second detector as a detection section to detect the predetermined operation, wherein the setting unit sets the first detection range as the detection section when the first detection target detected by the first detector is the moving object and the second detection target detected by the second detector is the stationary object, and sets the second detection range as the detection section when the first detection target detected by the first detector is the stationary object and the second detection target detected by the second detector is the moving object.

6. The door opening and closing device according to claim 1, further comprising a calculation unit that calculates a coordinate of the moving object from the distance detected by the first detector and the distance detected by the second detector, wherein a first coordinate, which is the coordinate obtained at a stage preceding the final stage, and a second coordinate, which is the coordinate obtained when the final stage is performed, are used to determine establishment of the predetermined operation by the control unit, and the control unit determines that the predetermined operation is established when a difference between the first coordinate and the second coordinate is smaller than a second determination value, and determines that the predetermined operation is not established when the difference between the first coordinate and the second coordinate is equal to or larger than the second determination value.

7. The door opening and closing device according to claim 5, further comprising a storage unit that stores the detection section set by the setting unit, wherein storage information of a first detection section, which is the detection section set by the setting unit at a stage preceding the final stage, and storage information of a second detection section, which is the detection section set by the setting unit when the final stage is performed, are used to determine establishment of the predetermined operation by the control unit, and the control unit determines that the predetermined operation is established when the first detection section is identical to the second detection section, and determines that the predetermined operation is not established when the first detection section is different from the second detection section.

8. The door opening and closing device according to claim 1, wherein in each of the first detection range of the first detector and the second detection range of the second detector, a start section and a trigger section located closer to the door than the start section are set, and the predetermined operation includes a stage of moving from the start section to the trigger section and a stage of moving from the trigger section to the start section.

9. The door opening and closing device according to claim 8, wherein a boundary line separating the start section and the trigger section includes a first boundary line and a second boundary line located farther from the door than the first boundary line, and the control unit detects the predetermined operation based on the first boundary line when the distance to the stationary object is shorter than the first determination value, and detects the predetermined operation based on the second boundary line when the distance to the stationary object is not shorter than the first determination value.

* * * * *